US006065550A

United States Patent [19]

Gardes

[11] Patent Number: 6,065,550

[45] **Date of Patent: *May 23, 2000**

[54] METHOD AND SYSTEM FOR DRILLING AND COMPLETING UNDERBALANCED MULTILATERAL WELLS UTILIZING A DUAL STRING TECHNIQUE IN A LIVE WELL

[76] Inventor: Robert Gardes, P.O. Box 92593, Lafayette, La. 70509

[ * ] Notice: This patent is subject to a terminal disclaimer.

[21] Appl. No.: 09/026,270

[22] Filed: Feb. 19, 1998

Related U.S. Application Data

[63] Continuation-in-part of application No. 08/595,594, Feb. 1, 1996, Pat. No. 5,720,356.

[51] Int. Cl.[7] ..... E21B 7/04; E21B 43/12

[52] U.S. Cl. ..... 175/62; 166/50; 166/313; 175/70

[58] Field of Search ..... 175/61, 62, 69, 175/70; 166/50, 313, 117.5, 117.6

[56] References Cited

U.S. PATENT DOCUMENTS

| | | | |
|---|---|---|---|
| 5,411,105 | 5/1995 | Gray | 175/69 |
| 5,720,356 | 2/1998 | Gardes | 175/62 |

OTHER PUBLICATIONS

Rotating control head applications increasing, Adam T. Bourgoyne, Jr., Oil & Gas Journal, Oct. 9, 1995.

*Primary Examiner*—William Neuder

*Attorney, Agent, or Firm*—Garvey, Smith, Nehrbass & Doody, LLC

[57] ABSTRACT

A method and system of drilling multiple radial wells using underbalanced drilling, by first drilling a principal wellbore; then providing a first carrier string having a deflection member on its lowermost end to a certain depth within the principal wellbore; orienting the deflection member into a predetermined direction; lowering a second drill string, such as coiled tubing or segmented drill pipe, down the bore of the carrier string, so that the drill bit on the end of the second string is deflected by the deflection member in the predetermined direction from the principal wellbore and a first multilateral well is drilled. When coiled tubing is used, fluid is pumped downhole through the annulus of the coiled tubing, and into an annular space between the coiled tubing and the carrier string so that it co-mingles with produced hydrocarbons; and the co-mingled fluids and any hydrocarbons are returned to the rig through the annular space between the borehole and the carrier string. When segmented drill pipe is used, fluid is pumped down the bore of the drill pipe and down the annular space between the carrier string and the borehole, and fluid and any hydrocarbons are returned up the annular space between the drill pipe and the carrier string; in either method, maintaining an underbalanced borehole, so that addtional multilateral wells may be completed while the well is alive and producing.

19 Claims, 16 Drawing Sheets

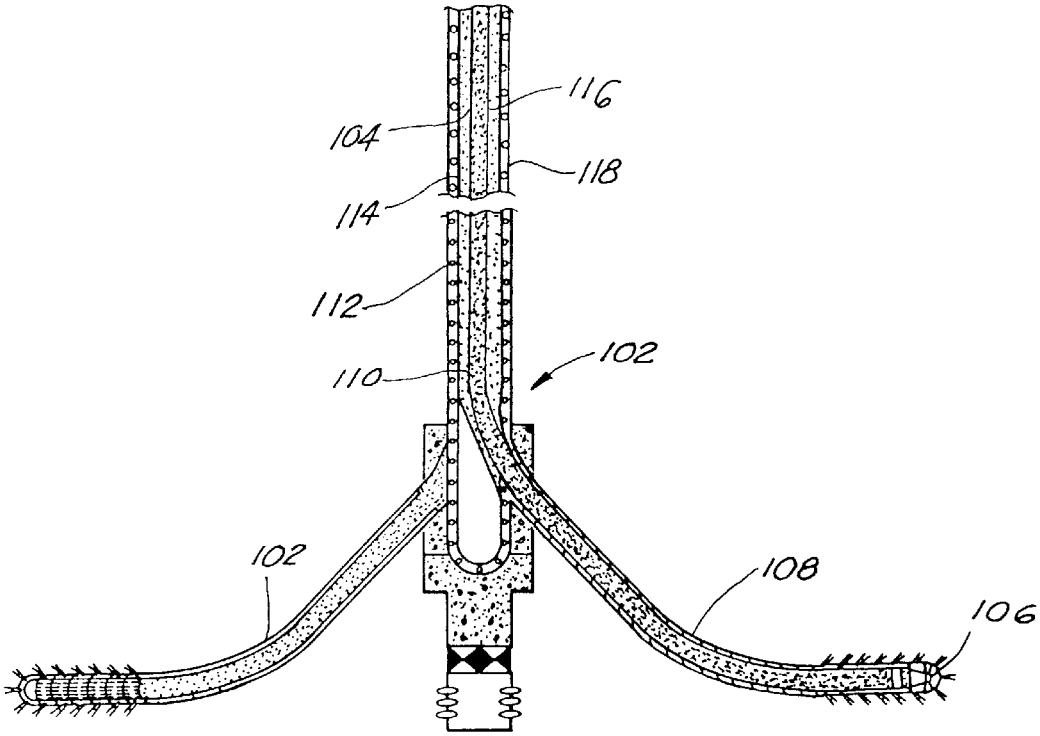
FIG. 10A
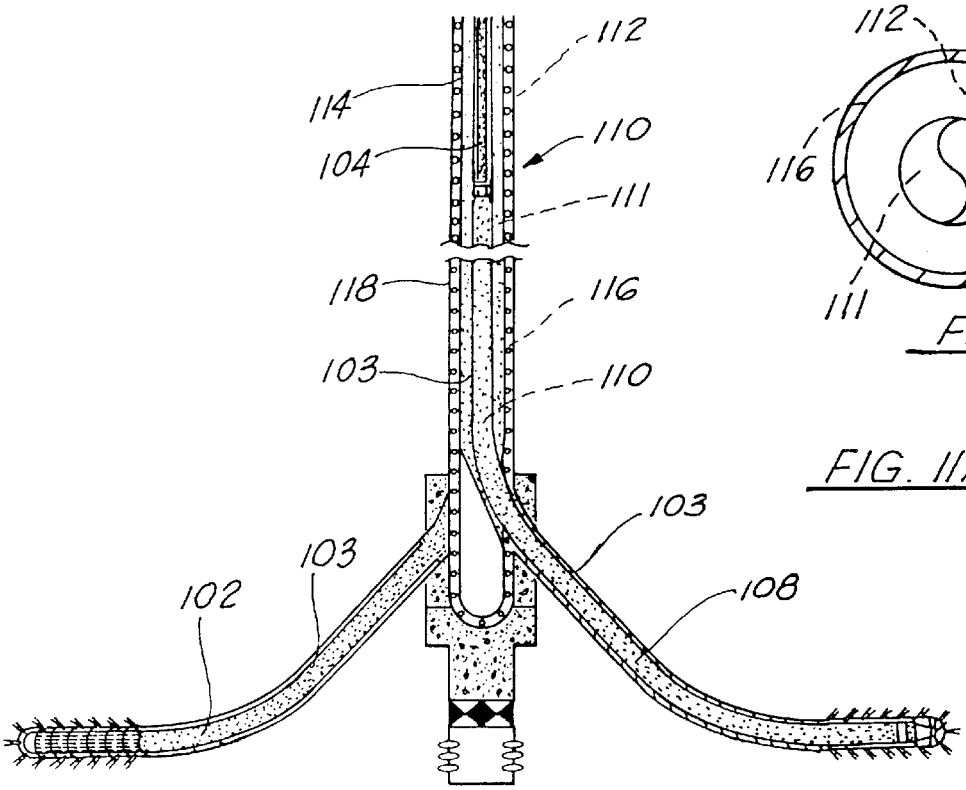
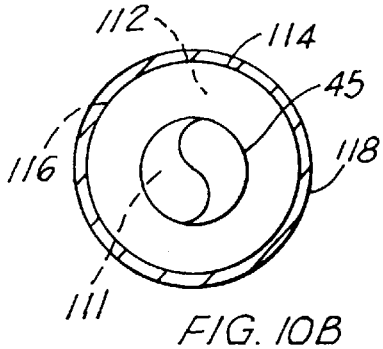
FIG. 10B
FIG. 11A

METHOD AND SYSTEM FOR DRILLING AND COMPLETING UNDERBALANCED MULTILATERAL WELLS UTILIZING A DUAL STRING TECHNIQUE IN A LIVE WELL

CROSS-REFERENCE TO RELATED APPLICATIONS

This is a continuation-in-part application of co-pending U.S. patent application Ser. No. 08/595,594, filed Feb. 1, 1996, incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The system of the present invention relates to underbalanced multilateral drilling and completing of oil wells. More particularly, the present invention relates to a system for drilling and completing a series of multilateral wells off of a single wellbore in an underbalanced system, utilizing a two-string technique, without having to kill the principal wellbore so that all of the multilaterals are drilled or completed while the well is alive.

2. General Background of the Invention

In the drilling of oil wells, one of the most critical elements in drilling has always been to maintain the well in a balanced state, so that should the drill bit strike a pocket of hydrocarbons, that the formation pressure does not overcome the hydrostatic pressure in the well, and thus a blow out does not occur. Likewise, in the completing of oil wells, it is critical that during the completion process, the formation pressure does not overcome the hydrostatic pressure in the well and thus a blowout would not occur. In conventional drilling or completing, what has always been done, is during the drilling or completing process, to flow heavy fluids; i.e., muds, into the drill bore or into the oil well bore, during drilling, so that the hydrostatic pressure of the muds within the bore hole is heavier than the pressure from the formation. Therefore, any potential blowout which may occur otherwise is prevented due to the heavy muds which create the higher hydrostatic pressure downward into the formation.

It has been recently found, that when such a hydrostatic head is placed on the formation, often times the heavy muds or fluids flow into the formation, and by doing so, create severe damage of the formation, which is a detriment to the formation and to the productivity of the well itself. Therefore, there has been developed the technique that is called underbalanced drilling, which technique allows for greater production, and does not create formational damage which would impede the production process. Furthermore, it has been shown that productivity is enhanced in multilateral wells combined with the non-formation damaging affects of the underbalanced drilling. These results are accomplished by introducing a lighter fluid such as nitrogen or air into the drill hole, or a combination of same or other type fluids or gases, sufficiently as to create an underbalance so that fluid in the borehole does not move into the formation during drilling and completion. In order to accomplish this, often times the drilling is undertaken through the use of coiled tubing, which is a continuous line of tubing which unreels off of a spool on the rig floor, and the tubing serves as a continuous drill string for the drill bit at the end of the tubing. Another technique of underbalanced drilling is referred to as micro-annulus drilling where a low pressure reservoir is drilled with an aerated fluid in a closed system. In effect, a string of casing is lowered into the wellbore and utilizing a two string drilling technique, there is circulated a lighter fluid down the outer annulus, which lowers the hydrostatic pressure of the fluid inside the column, thus relieving the formation. This allows the fluid to be lighter than the formation pressure which, if it weren't, would cause everything to flow into the wellbore which is detrimental. By utilizing this system, drillers are able to circulate a lighter fluid which can return up either inner or outer annulus, which enables them to circulate with a different fluid down the drill string. In doing so, basically air and nitrogen are being introduced down the system which allows them to circulate two different combination fluids with two different strings. This also allows for well control during tripping of drilling assembly.

However, when not utilizing a two-string system, the well is being drilled as an underbalanced well. In order to do so, one must kill the well so that the drill string may be tripped out of the hole, until sufficient fluid in the bore to bring the flow to neutral so the wells aren't flowing. When this is done, the fluid which maintains the hydrostatic pressure on the well, may create formation damage because what is actually occurring is sufficient heavy fluid is in the well bore which forces the fluids into the formation thus the well is killed.

Therefore, what is currently being accomplished in the art is the attempts to undertake underbalanced drilling and to trip out of the hole without creating formation damage thereby controlling the pressure, yet hold the pressure so that one can trip out of the well with the well not being killed and maintaining a live well.

It is well known in the art that anytime a heavy fluid must be introduced into the borehole, in order to stop flowing of fluids of the borehole, there is damage being done to the reservoir downhole, which is not desirable. In the prior art which is being submitted with applicant's prior art statement, applicant brings attention to the many articles which have been written on underbalanced drilling, and the techniques which companies are introducing in order to attempt to maintain the wells alive while tripping in and out of the hole. For example, a company called Sperry Sun, in attempting underbalanced drilling, will aerate the fluid into the casing string which lowers the hydrostatic pressure of the well then you proceed to the micro-annulus system which is becoming the method of choice in combination with coiled tubing and jointed pipe systems. However, the basic wells which are being done are regular, singular horizontal wells and even with the micro-annulus system, restricted to a single well either horizontal or vertical.

Therefore, at this time in the art of micro-annulus drilling, what is needed is a system for micro-annulus drilling, utilizing the two string technique, which would allow you to go into drilling multiple radial wells off of the single vertical or horizontal well, without having to kill the well when the radial wells are drilled during the process.

BRIEF SUMMARY OF THE INVENTION

The system and method of the present invention solves the problems in the art in a simple and straight forward manner. What is provided is a system for drilling or completing multilateral wells from a single principal vertical directional, or horizontal well, using an underbalanced technique, which provides a first outer casing lining the wellbore or open hole section of said wellbore, a second inner casing, called a carrier string, which may be casing or drill pipe, as a second inner string, and either coiled tubing or regular drill pipe as the inner drill string. At this point in the process, there would be provided an orientation means for orienting the mud motor assembly off of the coiled tubing or jointed pipe. There is further provided an orientation system that attaches to the coiled tubing or jointed pipe so that the upstock or whipstock may be oriented in the proper orientation. An addtional means of orientation would be accomplished by self-orienting devices located in the primary string where the upstock would land in and be oriented by latch coupling device. Therefore, in either system, whipstock is properly oriented when the radials are drilled through the walls of the casing. Following this orientation, there would be provided a whipstock or upstock attached to the carrier string, which is lowered into the cased or uncased wellbore. The carrier string is lowered into the outer casing, hung off in either the well head or rotary table. Next the inner drilling assembly is lowered into the carrier string and when the drill bit makes contact with the deflecting surface of the whipstock or upstock, there is a bore drilled through the wall of the casing or into the open hole through conventional means depending on the type of material which the casing is constructed of or the type of wellbore to be drilled. In the preferred embodiment, the inner drill string is either drill pipe or a continuous string of coiled tubing having a drill bit and a mud motor assembly at the end of the tubing for rotating the drill bit, or in the case of jointed pipe, a mud motor assembly or rotary articulated horizontal assembly such as the Amoco System, or in the completion of wells, the inner string may be coiled tubing to serve as the innermost annulus of the completion string.

It should be known at this time, that although this discussion is centering around a cased borehole, this process as will be discussed can be utilized in the drilling of multilateral wells in open hole applications, and does not necessarily have to be utilized in conjunction with cased boreholes.

In the process of the underbalanced drilling or completing of wells, a first fluid is circulated down the annulus of the coiled tubing which fluid can be air or nitrogen or drilling fluid or a mixture thereof, which would drive the mud motor assembly and, in the case of drilling, rotate the drill bit. This would in the preferred embodiment be a non-damaging type fluid which would not cause damage to the surrounding formation. Simultaneously, there would be circulated down the annulus between the outer drill string and the inner drill string a second and possibly different fluid such as aerated nitrogen or nondamaging fluid in a combination so as not to cause damage to the formation. The two fluids would then be co-mingled at the point where the drill bit exits the upstock when a well is being drilled, and returned as a co-mingled fluid in the annular space between the carrier string and the casing of the borehole and returned to the separators via the surface control systems. In an additional embodiment, the two co-mingled fluids may return to the surface control system and separators in an annular space between the carrier string and the inner string rather than the carrier string and the outer casing.

When a well is being drilled using the underbalanced technique, the drill bit is to be retrieved from drilling a multilateral well, a tripping fluid of proper weight would then be pumped down the annulus between the carrier string and the drill string, the trip fluid in a weight ratio to displace the pipe so that the hydrostatic pressure in the carrier string would not allow fluid to flow up the carrier string while the drill string is being retrieved through it so that the clear lighter fluid that was being circulated in combination is still making contact with the formation and the tripping fluid is circulated and keeps the wellbore pressure under control during tripping phases and thus does not damage the formation and the well is essentially being drilled as a live well within the main well bore. The carrier string with the upstock on its end would then be repositioned at a different point in the borehole, while the well is still alive, and the coiled tubing or drill pipe could be relowered into the borehole to drill the next multilateral. This drilling of additional multilaterals and various orientations could be accomplished while the well is maintained as a live well, so long as the fluid pressure is underbalanced within the well bore through a combination of fluids in the drill string and carrier string.

Therefore, it is a principal object of the present invention to provide a drilling technique for multiple radials, utilizing an underbalanced system which allows radials to be drilled off of a single borehole while the well is maintained as a live producing well during the process;

It is a further principal object of the present invention to provide a well completion technique for completing multilateral wells, off of a principal wellbore, utilizing an underbalanced system which allows multilaterals to be completed off of a principal borehole while the principal wellbore is maintained as a live producing well during the process.

It is a further principal object of the present invention to provide a system of underbalanced during or completing of multilateral wells, so that each of the multilateral wells is drilled or completed while the well is alive, and no damaging fluids or muds make contact with the formation which may do damage to the formation;

It is a further object of the present invention to drill or complete multiple multilateral wells from a principal wellbore without having to kill the principal well in order to drill or complete the additional multilateral wells;

It is a further object of the present invention to provide a two-string technique in underbalanced drilling or completing of multilateral wells so that at least a first fluid is pumped down the annuli of the coiled tubing or drill pipe, and a second fluid is pumped down the annulus between a carrier string and the inner string, so that the co-mingled fluids are returned up to the surface fluid handling facilities through an outer annulus between the casing and the carrier string;

It is a further object of the present invention to provide fluid circulated down the drill pipe while second fluid is circulated down the annulus between the outer casing and the carrier string with co-mingled fluids returning up the annulus between the drill pipe and the carrier string to the surface control system and separators;

It is a further object of the present invention to provide a two-string technique in underbalanced drilling or completing of multilateral wells so that at least one fluid is pumped down the annuli of the coiled tubing or drill pipe, and a second fluid is pumped down the annulus between the casing and the carrier string, so that the co-mingled fluids are returned up to the surface fluid handling facilities through an annulus between the carrier string and the jointed drill pipe;

It is the further object of the present invention to provide a two-string drilling or completing technique utilizing coiled tubing or drill pipe as the drill or completion string and a carrier string as the outer string, so that two different fluids can be utilized in an underbalanced system of multilateral wellbores while the principal wellbore is being maintained as a live producing well.

It is a further object of the present invention to provide an underbalanced drilling or completing technique for multilateral wells, by utilizing two different fluids pumped down the borehole with at least one of the fluids making contact with the formation so that the formation is not harmed by the fluid flowing past the formation during the drilling or completing process.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 10A illustrates an isolated view of the lower portion of the drilling/completion subsystem as fully illustrated in FIG. 10;

FIG. 10B illustrates a cross-sectional view of the outer casing housing the carrier string, and the drill pipe within the carrier string in the dual string drilling system utilizing segmented drill pipe;

FIG. 11A illustrates an isolated view of the lower portion of the drilling/completion subsystem as fully illustrated in FIG. 11.

DETAILED DESCRIPTION OF THE INVENTION

Figure 1:
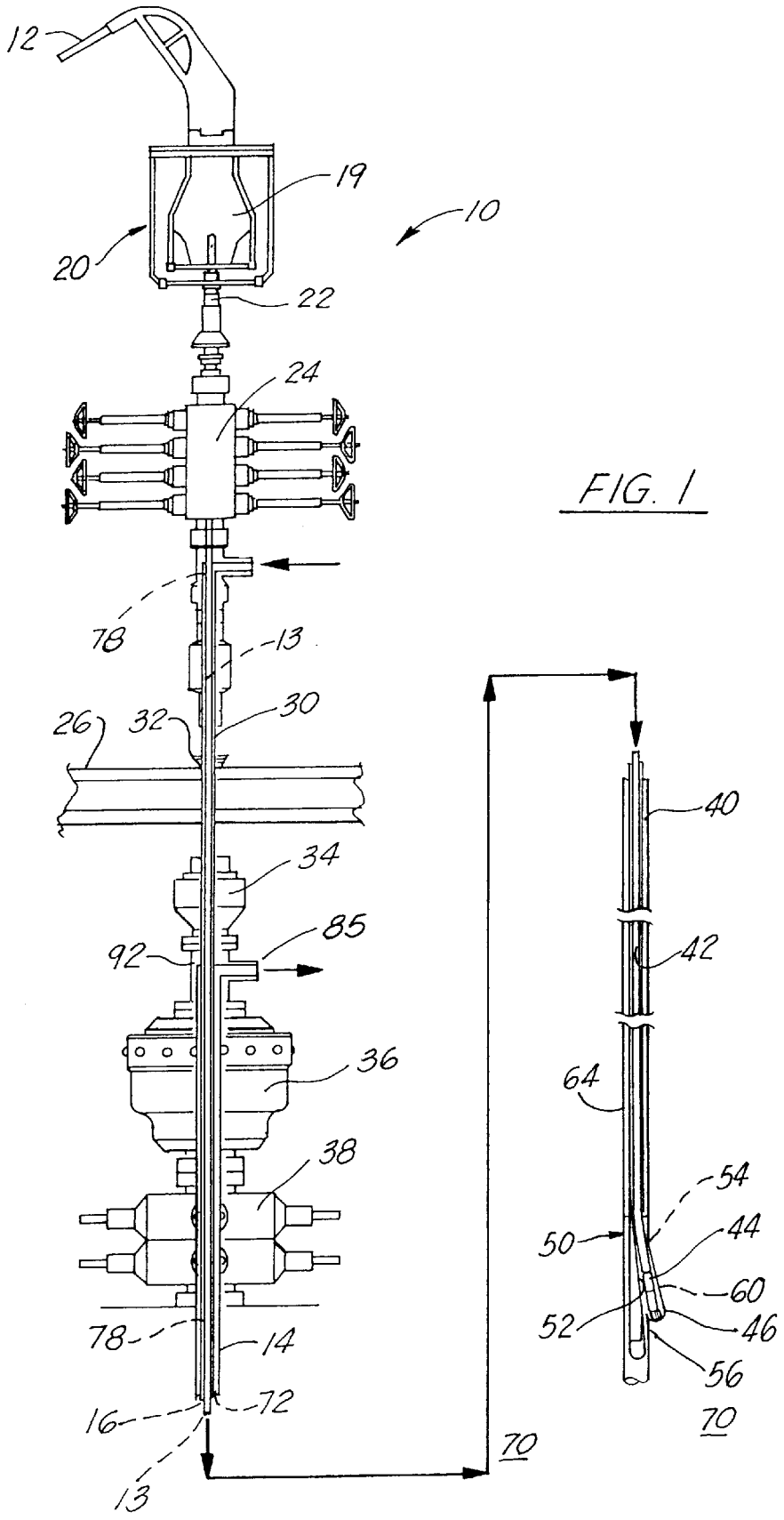
FIG. 1 illustrates an overall view of the two string underbalanced drilling technique utilizing coiled tubing as the drill string in the drilling of multiple radials.

FIGS. 1–12 illustrate the preferred embodiments of the system and method of the present invention for drilling underbalanced radial wells utilizing a dual string technique in a live well. As illustrated in FIG. 1, what is provided is a drilling system 10 utilizing coil tubing as the drill string. As illustrated, the coil tubing 12 which is known in the art, and comprises a continuous length of tubing, which is lowered usually into a cased well having an outer casing 14 placed to a certain depth within the borehole 16. It should be kept in mind that during the course of this application, reference will be made to a cased borehole 16, although the system and method of the present invention may be utilized in a non-cased or "open" borehole, as the case may be. Returning to FIG. 1, the length of coil tubing 12 is inserted into the injector head 19 of the coil tubing assembly 20, with the coil tubing 12 being rolled off of a continuous reel mounted adjacent the rig floor 26. The coil tubing 12 is lowered through the stripper 22 and through the coil tubing blowout preventer stack 24 where it extends down through the rig floor 26 where a carrier string 30 is held in place by the slips 32. Beneath the rig floor 26 there are a number of systems including the rotating drill head 34, the hydril 36, and the lower BOP stack 38, through which the coil tubing 12 extends as it is moved down the carrier string 30. It should be understood that when coiled tubing 12 is utilized in the drilling of oil wells, the drill bit is rotated by the use of a drill motor, since the coiled tubing is not rotated as would be segmented drill pipe.

Since the system in which the coil tubing 12 is being utilized in this particular application is a system for drilling radial wells, on the lower end of the coil tubing 12, there are certain systems which enable it to be oriented in a certain direction downhole so that the proper radial bore may be drilled from the horizontal or vertical lined cased borehole 16. These systems may include a gyro, steering tool, electromagnetic MWD and fluid pulsed MWD, at the end of which includes a mud motor 44, which rotates the drill bit 46 for drilling the radial well. As further illustrated in FIG. 1, on the lower end of the carrier string 30 there is provided a deflector means which comprises an upstock 50, which is known in the art and includes an angulated ramp 52, and an opening 54 in the wall 56 of the upstock 50, so that as the drill bit 46 makes contact with the ramp 52, the drill bit 46 is deflected from the ramp 52 and drills through the wall 56 of the casing 14 for drilling the radial borehole 60 from the cased borehole 16. In a preferred embodiment, there may be a portion of composite casing 64 which has been placed at a predetermined depth within the borehole, so that when the drill bit 46 drills through the wall 56 of the casing 14 at that predetermined depth, the bit easily cuts through the composite casing and on to drill the radial well.

Following the steps that may be taken to secure the radial bore as it enters into the cased well 14, such as cementing or the like, it is that point that the underbalanced drilling technique is undertaken. This is to prevent any blowout or the like from moving up the borehole 16 onto the rig 26 which would damage the system on the rig or worse yet, injure or kill workers on the rig. As was noted earlier in this application, the underbalanced technique is utilized so that the fluids that are normally pumped down the borehole 16, heavy fluids and muds which are normally dumped down the borehole 16, in order to maintain the necessary hydrostatic pressure, are not utilized. What is utilized in underbalanced drilling, is a combination of fluids which are of sufficient weight to maintain a lower than formation hydrostatic pressure in the borehole yet not to move into the formation 70 which can cause damage.

Figures 2, 2A:
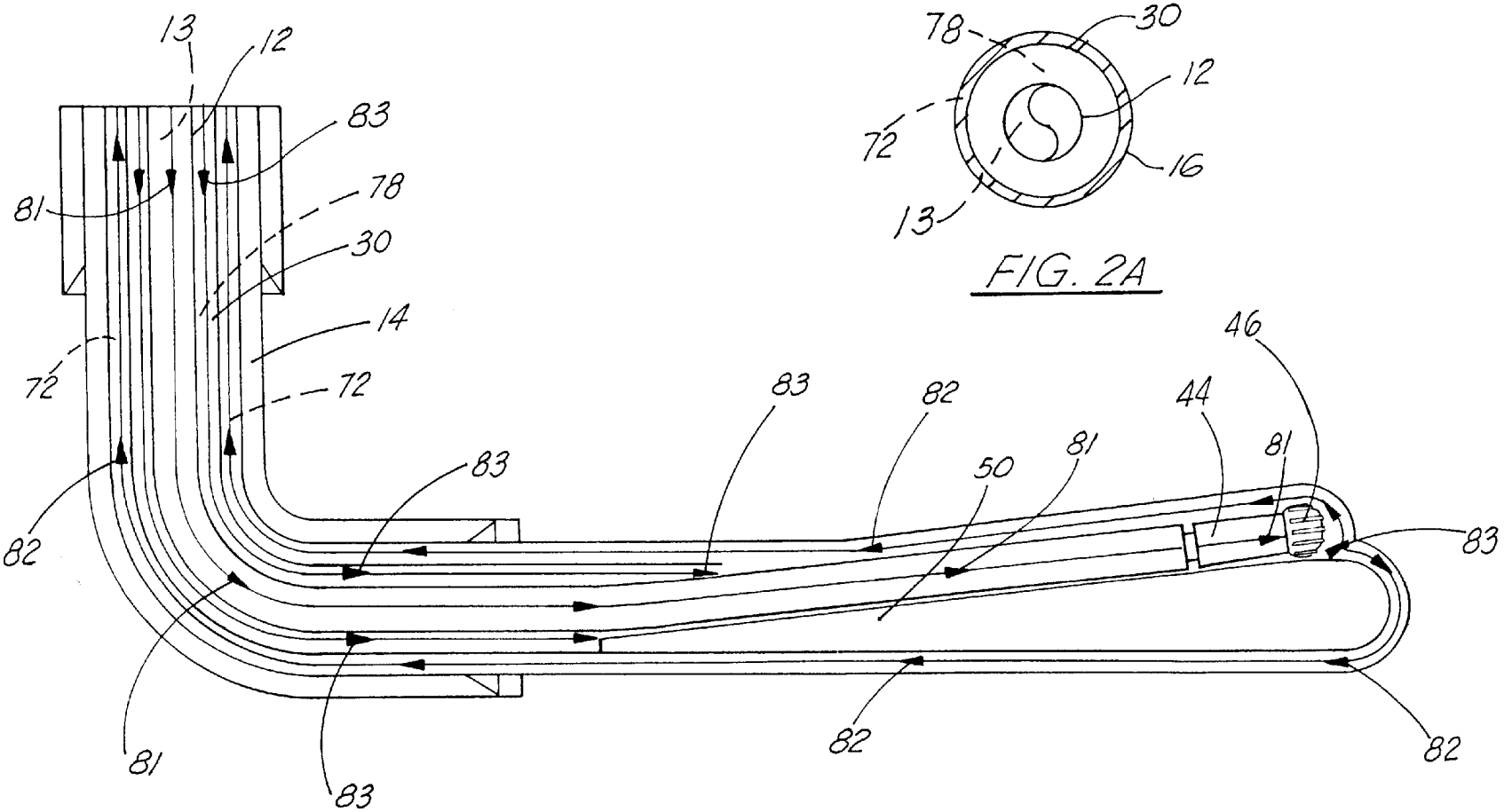
FIGS. 2 and 2A illustrates partial cross-sectional views of the whipstock or upstock portion of the two string drilling technique and the fluids flowing therethrough during the underbalanced drilling process utilizing coiled tubing.

In order to carry out the method of the system, reference is made to FIGS. 1 and 2. Again, one should keep in mind that the outer casing 14 lines the formation 70, and within the outer casing 14 there is a smaller carrier string 30 casing, which may be a 5" casing, which is lowered into the outer casing 16 thus defining a first annulus 72, between the inner wall of the outer casing 16 and the outer wall of the carrier string 30. The carrier string 30 would extend upward above the rig floor 26 and would receive fluid from a first pump means 76 (see FIG. 7A), located on the rig floor 26 so that fluid is pumped within the second annulus 78. Positioned within the carrier string 30 is the coil tubing 12, which is normally 2" in diameter, and fits easily within the interior annulus of the carrier string, since the drill bit 46 on the coil tubing 12 is only 4¾" in diameter. Thus, there is defined a second annulus 78 between the wall of the coil tubing 12 and the wall of the carrier string 30. Likewise, the coil tubing 12 has a continuous bore therethrough, so that fluid may be pumped via a second pump 79 (see FIG. 7A) through the coil tubing annulus 13 in order to drive the 3⅜" mud motor and drive the 4¾" bit 46.

Therefore, it is seen that there are three different areas through which fluid may flow in the underbalanced technique of drilling. These areas include the inner bore 13 of the coil tubing 12, the first annulus 72 between the outer wall of the carrier string 30 and the inner wall of the outer casing 16, and the second annulus 78 between the coil tubing 12 and the carrier string 30. Therefore, in the underbalanced technique as was stated earlier, fluid is pumped down the bore 13 of the coil tubing 12, which, in turn, activates the mud motor 44 and the drill bit 46. After the radial well has been begun, and the prospect of hydrocarbons under pressure entering the annulus of the casings, fluids must be pumped downhole in order to maintain the proper hydrostatic pressure. However, again this hydrostatic pressure must not be so great as to force the fluids into the formation. Therefore, in the preferred embodiment, in the underbalanced multilateral drilling technique, nitrogen gas, air, and water may be the fluid pumped down the borehole 13 of the coil tubing 12, through a first pump 79, located on the rig floor 36. Again, this is the fluid which drives the motor 44 and the drill bit 46. A second fluid mixture of nitrogen gas, air and fluid is pumped down the second annulus 78 between the 2" coiled tubing string 12 and the carrier string 30. This fluid flows through second annulus 78 and again, the fluid mixture in annulus 78 in combination with the fluid mixture through the bore 13 of the coil tubing 12 comprise the principal fluids for maintaining the hydrostatic pressure in the underbalanced drilling technique. So that the first fluid mixture which is being pumped through the bore 13 of the coil tubing 12, and the second fluid mixture which is being pumped through the second annular space 78 between the carrier string 30 and the coil tubing 12, reference is made to FIG. 2 in order understand the manner in which the fluid is returned up to the rig floor 26 so that it does not make contact with the formation.

Figure 6:
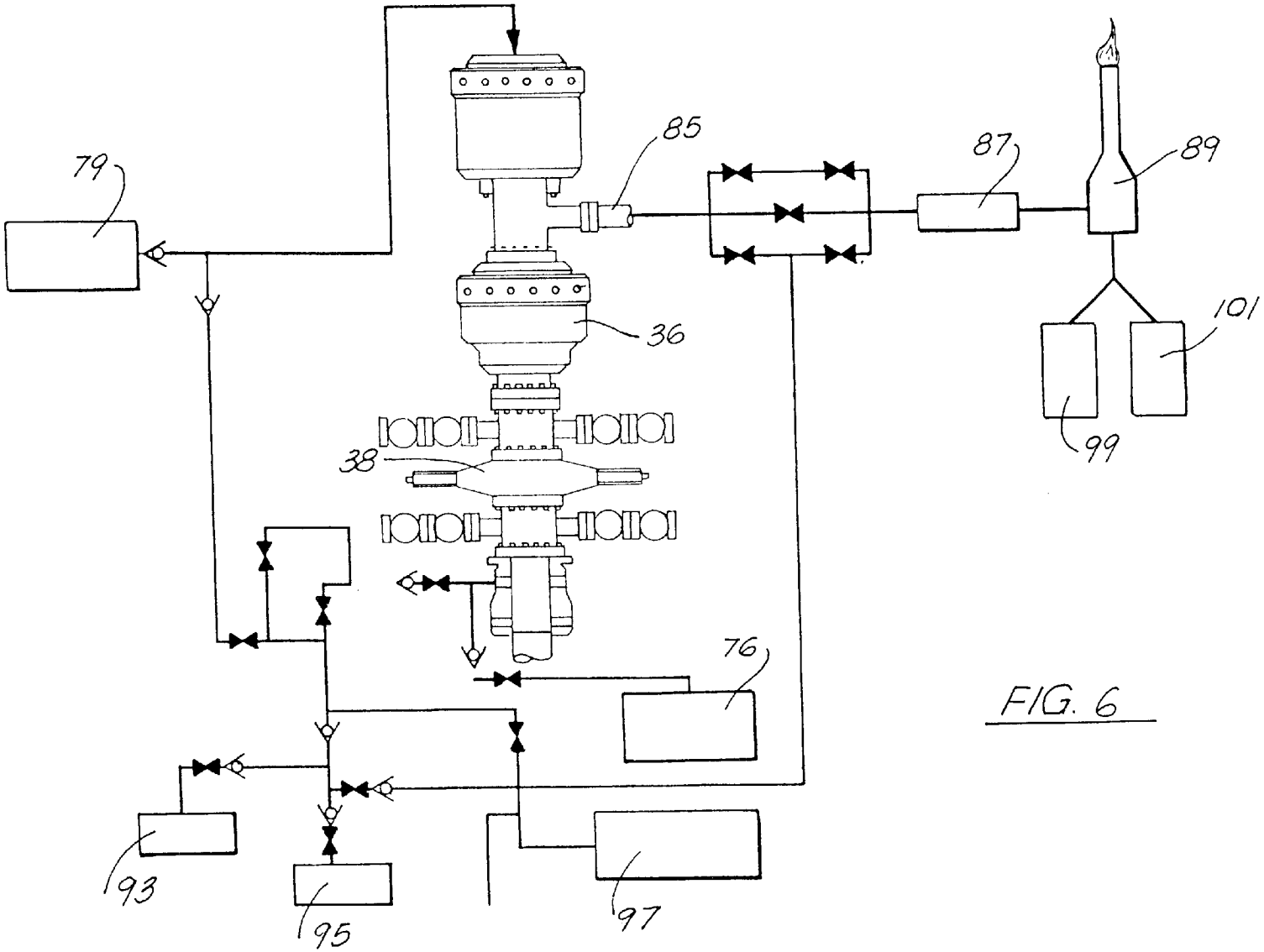
FIG. 6 illustrates an overall schematic view of an underbalanced drilling system utilized in the system of the method of the present invention.

As seen in FIG. 2, the fluid mixture through the bore 13 of the coil tubing 12 flows through the bore 13 and drives the mud motor 44 and flows through the drill bit 46. Simultaneously the fluid mix is flowing through the second annular space 78 between the carrier string 30 and the coil tubing 12, and likewise flows out of the upstock 50. However, reference is made to the first annular space between the outer casing 14 and the carrier string 30, which is that space 72 which returns any fluid that is flowing downhole back up to the rig floor 26. As seen in FIG. 2, arrows 81 represent the fluid flow down the bore 13 of the coil tubing 12, arrows 83 represent the second fluid flowing through the second annular space 78 into the borehole 12, and arrow 82 represents the return of the fluid in the first annular space 72. Therefore, all of the fluid flowing into the drill bit 46 and into the bore 12 so as to maintain the hydrostatic pressure is immediately returned up through the outer annular space 72 to be returned to the separator 87 through pipe 85 as seen in FIGS. 1 & 6.

FIG. 2A illustrates in cross sectional view the dual string system, wherein the coiled tubing 12 is positioned within the carrier string 30, and the carrier string is being housed within casing 16. In this system, there would be defined an inner bore 13 in coiled tubing 12, a second annulus 78 between the carrier string 30 and the coiled tubing 12, and a third annulus 72 between the casing 18 and the carrier string 30. During the process of recovery, the drilling or completion fluids are pumped down annuli 13 and 78, and the returns, which may be a mixture of hydrocarbons and drilling fluids are returned up through annulus 72.

During the drilling technique should hydrocarbons be found at one point during this process, then the hydrocarbons will likewise flow up the annular space 72 together with the return air and nitrogen and drilling fluid that was flowing down through the tube flowbores or flow passageways 13 and 78. At that point, the fluids carrying the hydrocarbons if there are hydrocarbons, flow out to the separator 87, where in the separator 87, the oil is separated from the water, and any hydrocarbon gases then go to the flare stack 89 (FIG. 6). This schematic flow is seen in FIG. 6 of the application.

Figure 3C:
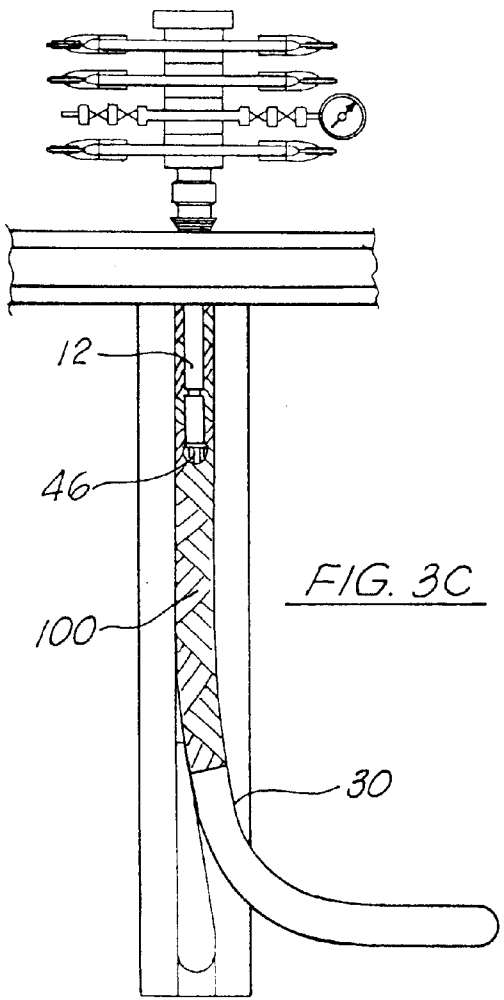
FIGS. 3A–3C illustrate views of the underbalanced drilling technique utilizing the fluid for maintaining the underbalanced status of the well during a retrieval of the coiled tubing drill string.
Figure 3B:
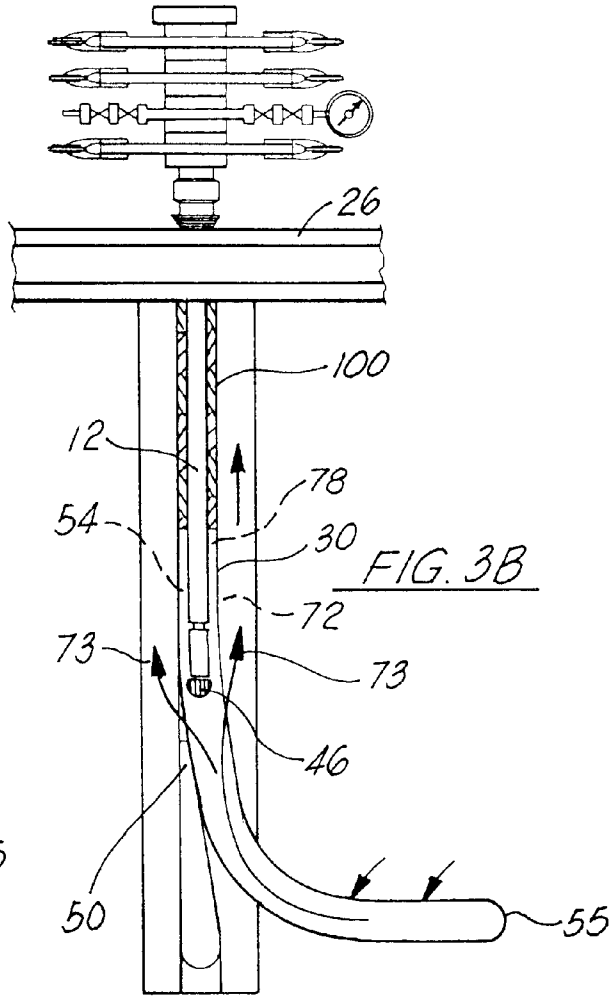
Figure 3A:
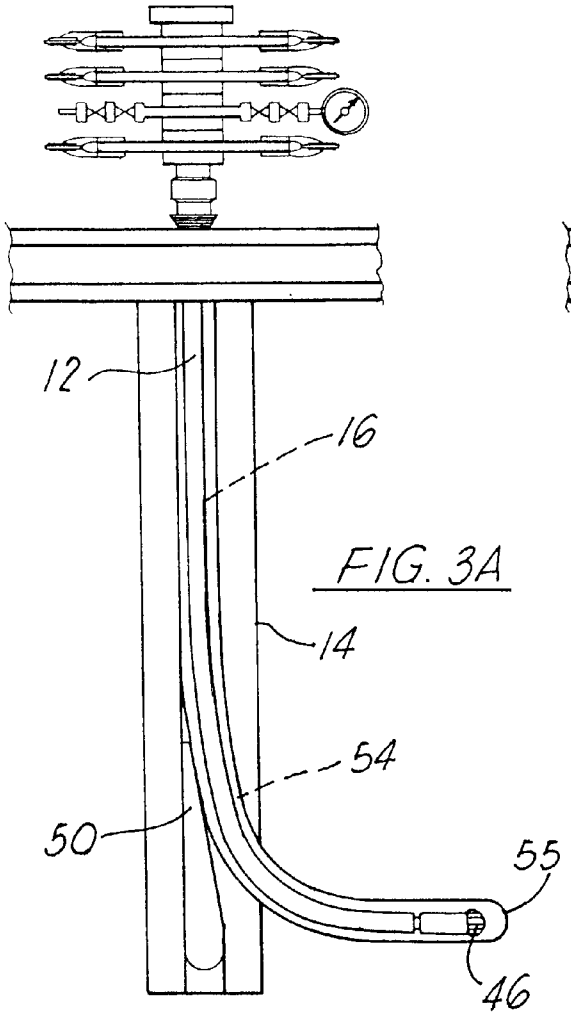

One of the more critical aspects of this particular manner of drilling wells in the underbalanced technique, is the fact that the underbalanced drilling technique would be utilized in the present invention in the way of drilling multiple radial wells from one vertical or horizontal well without having to kill the well in order to drill additional radials. This was discussed earlier. However, as illustrated in FIGS. 3A–3C, reference is made to the sequential drawings, which illustrate the use of the present invention in drilling radial wells. For example, as was discussed earlier, as seen in FIG. 3A, when the coil tubing 12 encounters the upstock 50, and bores through an opening 54 in the wall of outer casing 14, the first radial is then drilled to a certain point 55. At some point in the drilling, the coil tubing string 12 must be retrieved from the borehole 16 in order to make BHA changes or for completion. In the present state of the art, what is normally accomplished is that the well is killed in that sufficient weighted fluid is pumped into the wellbore to stop the formation from producing so that there can be no movement upward through the borehole by hydrocarbons under pressure while the drill string is being retrieved from the hole and subsequently completed.

This is an undesirable situation. Therefore, what is provided as seen in FIGS. 3B and 3C, where the coil tubing 12, when it begins to be retrieved from the hole, there is provided a trip fluid 100, circulated into the second annular space 78 between the wall of the coil tubing 12 and the wall of the carrier string 30. This trip fluid 100 is a combination of fluids, which are sufficient to maintain any hydrocarbons from flowing through the carrier string 30 upward, yet do not go into the formation. Rather, if there are hydrocarbons which flow upward they encounter the trip fluid 100 and flow in the direction of arrows 73 through the first annular space 72 between the carrier string 30 and the outer casing 14, and flow upward to the rig floor 26 and into the separators 87 as was discussed earlier. However, the carrier string 30 is always "alive" as the coil tubing 12 with the drill bit 46 is retrieved upward. As seen in FIG. 3C, the trip fluid 100 is circulated within the carrier string 30, so that as the drill bit 46 is retrieved from the bore of the carrier string 30, the trip fluid 100 maintains a certain equilibrium within the system, and the well is maintained alive and under control.

Figure 4A:
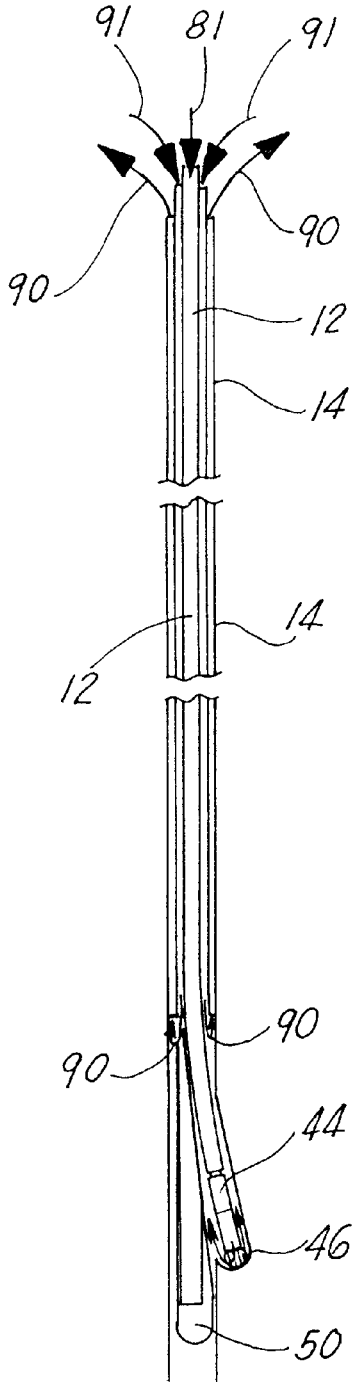
FIGS. 4A & 4B illustrate a flow diagram for underbalanced drilling utilizing a two-string drilling technique in an upstock assembly with the fluid being returned through the annulus between the carrier string and the outer string.
Figure 4B:
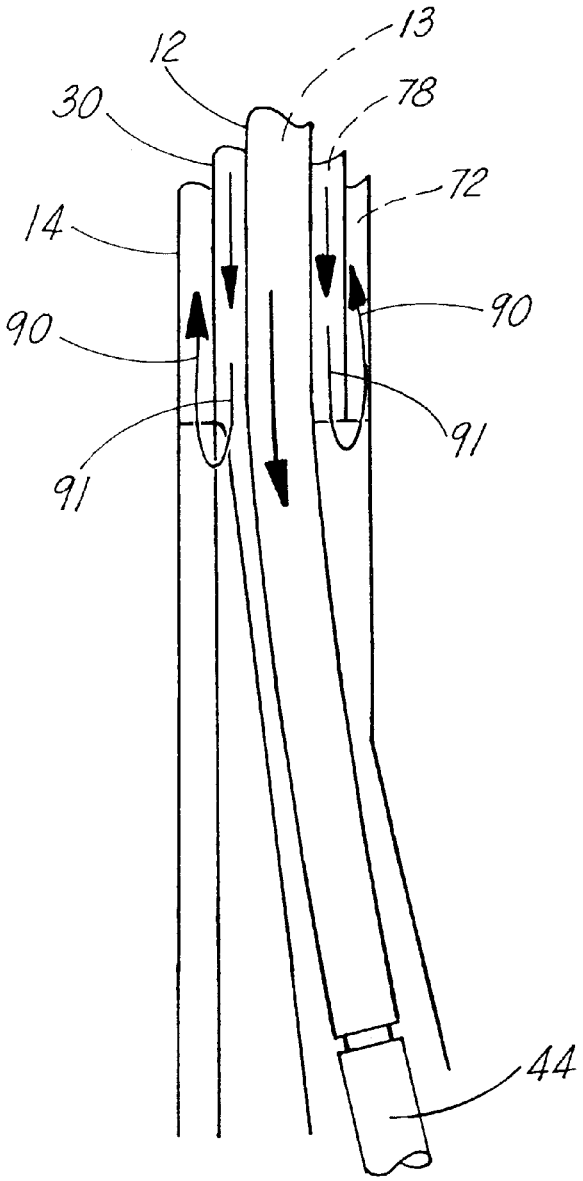
Figure 5:
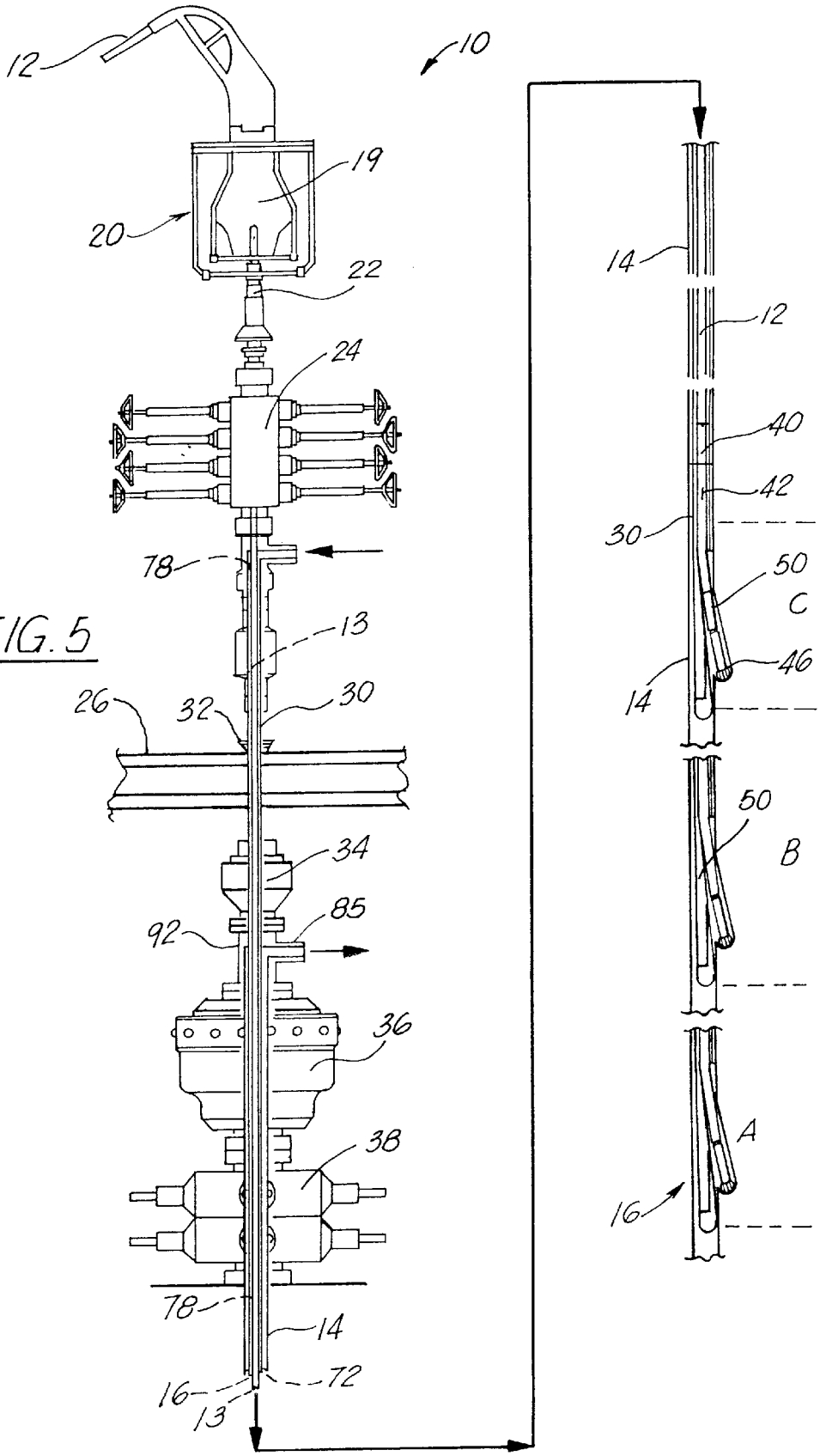
FIG. 5 illustrates a partial view of the underbalanced drilling technique showing the drilling of multiple radial wells from a single vertical or horizontal well while the well is maintained in the live status within the bore hole.

Therefore, FIG. 5 illustrates the utilization of the technique as seen in FIGS. 3A–3C, in drilling multiple radials off of the vertical or horizontal well. As illustrated for example, in FIG. 5, a first radial would be drilled at point A along the bore hole 16, utilizing the carrier string 30 as a downhole kill string 100 as described in FIG. C. Maintaining the radial well in the underbalanced mode, through the use of trip mode circulation 100, the drill bit 46 and coil tubing 12 is retrieved upward, and the upstock 50 is moved upward to a position B as illustrated in FIG. 5. At this point, a second radial well is drilled utilizing the same technique as described in FIG. 3, until the radial well is drilled and the circulation maintains underbalanced state and well control. The coil tubing 12 with the bit 46 is retrieved once more, to level C at which point a third radial well is drilled. It should be kept in mind that throughout the drilling and completion of the three wells at the three different levels A, B, C, the hydrostatic pressure within the carrier string 30 will be maintained by circulation down the carrier string to maintain wellbore control, and any hydrocarbons which may flow, may flow upward within annulus 72 between the carrier string 30 and the outer casing 14. Therefore, utilizing this technique, each of the three wells are drilled and completed as live wells, and the multiple radials can be drilled while the carrier string 30 is alive as the drill bit 46 and carrier string 30 are retrieved upward to another level. FIGS. 4A & 4B illustrate the flow diagram in isolation for underbalanced drilling utilizing the two-string drilling technique in an upstock assembly with the fluid flowing down the annulus 78 between the drill pipe 12 and the carrier string 30, and being returned through the annulus 72 between the carrier string 30 and the outer casing 16.

FIG. 6 is simply an illustration in schematic form of the various nitrogen units 93, 95, and rig pumps 76, 79 including the air compressor 97 which are utilized in order to pump the combination of air, nitrogen and drilling fluid down the hole during the underbalanced technique and to likewise receive the return flow of air, nitrogen, water and oil into the separator 57 where it is separated into oil 99 and water 101 and any hydrocarbon gases are then burned off at flare stack 89. Therefore, in the preferred embodiment, this invention, by utilizing the underbalanced technique, numerous radial wells 60 can be drilled off of a borehole 16, while the well is still alive, and yet none of the fluid which is utilized in the underbalanced technique for maintaining the proper equilibrium within the borehole 16, moves into the formation and causes any damage to the formation in the process.

Figure 7A:
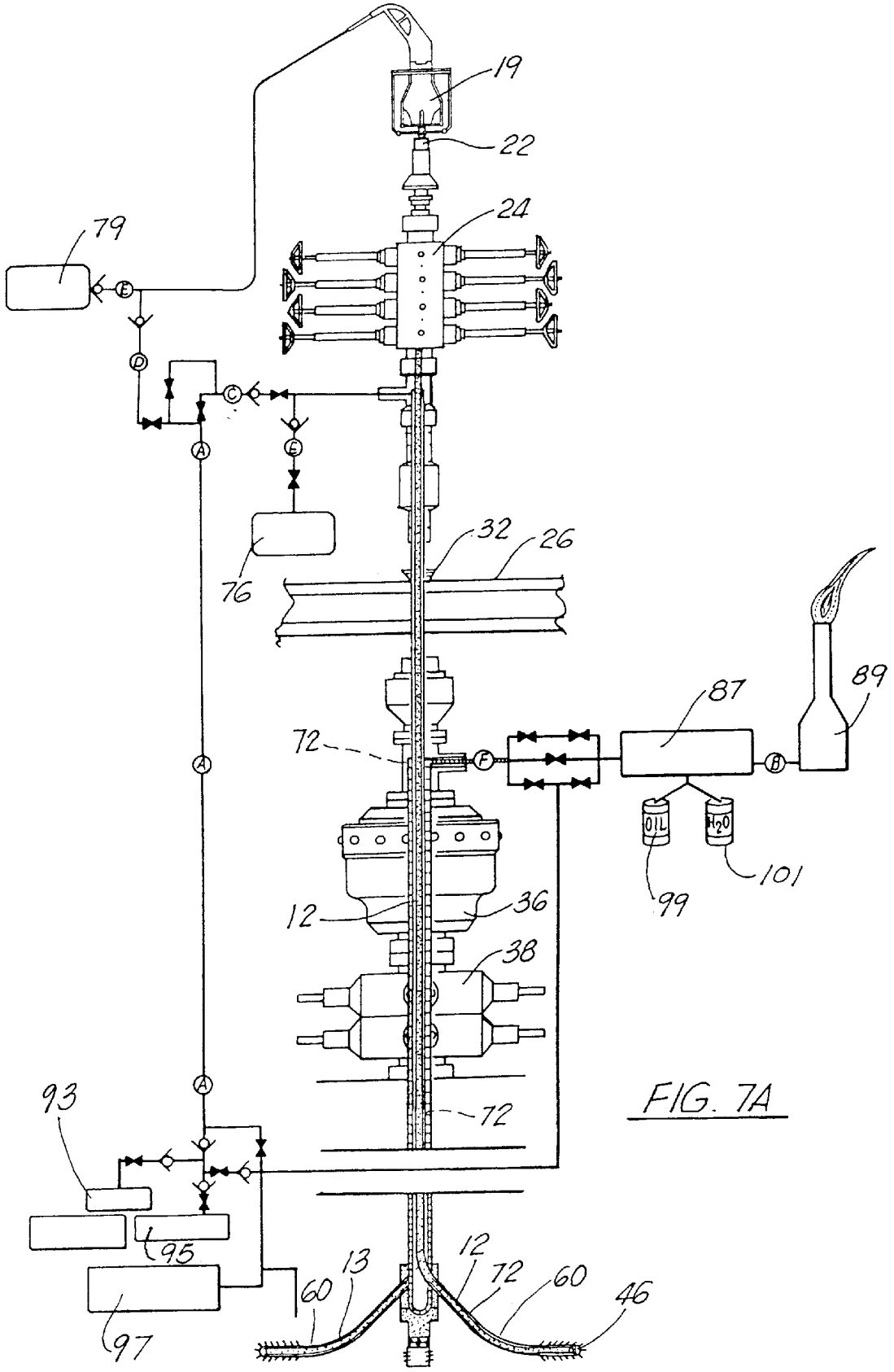
FIG. 7A illustrates an overall schematic view of an underbalanced radial drilling (with surface schematic) while producing from a wellbore being drilled, and a wellbore that has been drilled and is currently producing, with FIG. 7B illustrating a partial view of the system.
Figure 7B:
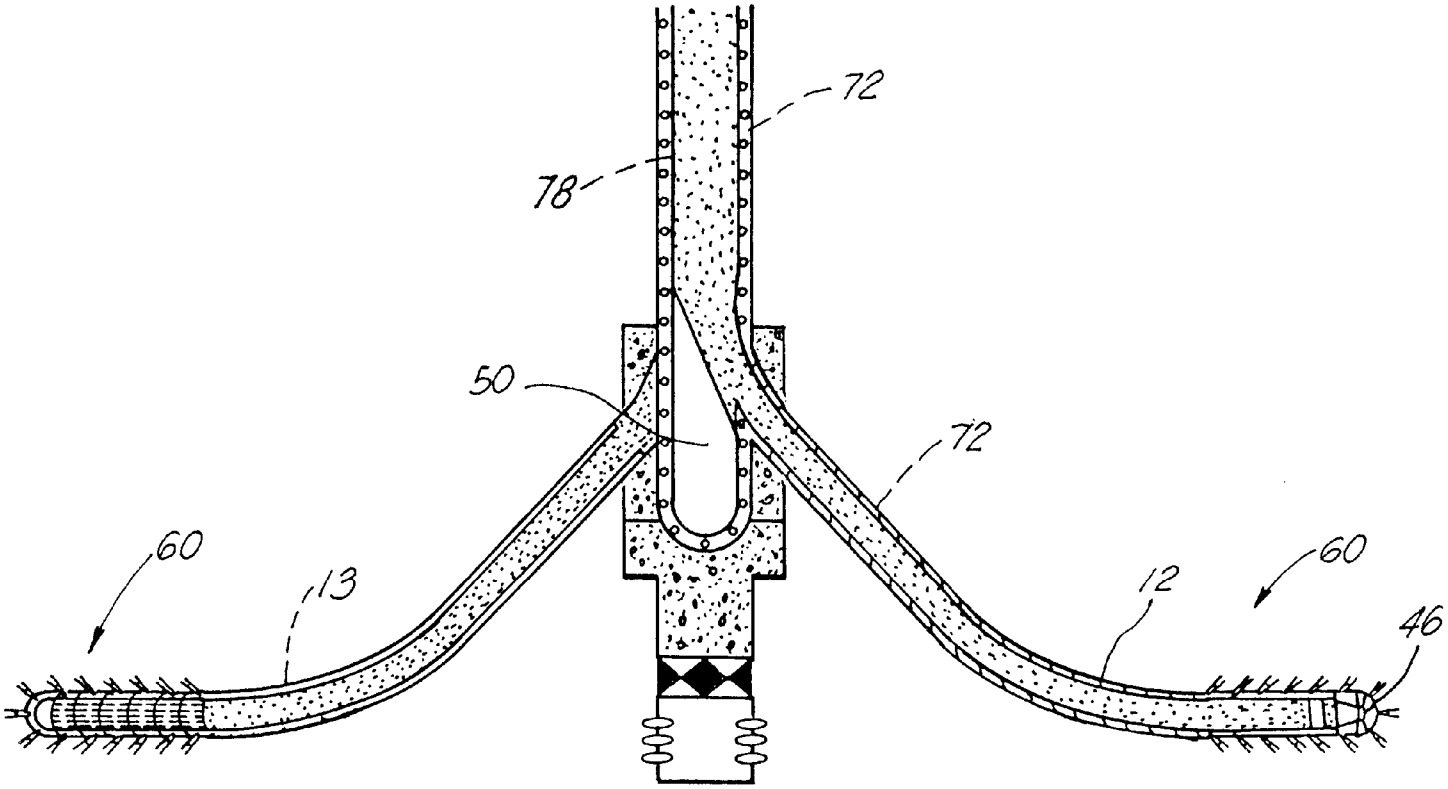

FIGS. 7A and 7B illustrate in overall and isolated views respectively, the well producing from a first radial borehole 60 while the radial borehole is being drilled, and is likewise simultaneously producing from a second radial borehole 60 after the radial borehole has been completed. As is illustrated, first radial borehole 60 being drilled, the coil tubing string 12 is currently in the borehole 60, and is drilling via drill bit 46. The hydrocarbons which are obtained during drilling return through the radial borehole via annulus 72 between the wall of the borehole, and the wall of the coiled tubing 12. Likewise, the second radial borehole 60 which is a fully producing borehole, in this borehole, the coil tubing 12 has been withdrawn from the radial borehole 60, and hydrocarbons are flowing through the inner bore of radial borehole 60 which would then join with the hydrocarbon stream moving up the borehole via first radial well 60, the two streams then combining to flow up the outer annulus 72 within the borehole to be collected in the separator. Of course, the return of the hydrocarbons up annulus 72 would include the air/nitrogen gas mixture, together with the drilling fluids, all of which were used downhole during the underbalanced drilling process discussed earlier. These fluids, which are comingled with the hydrocarbons flowing to the surface, would be separated out later in separator 87.

Figure 8A:
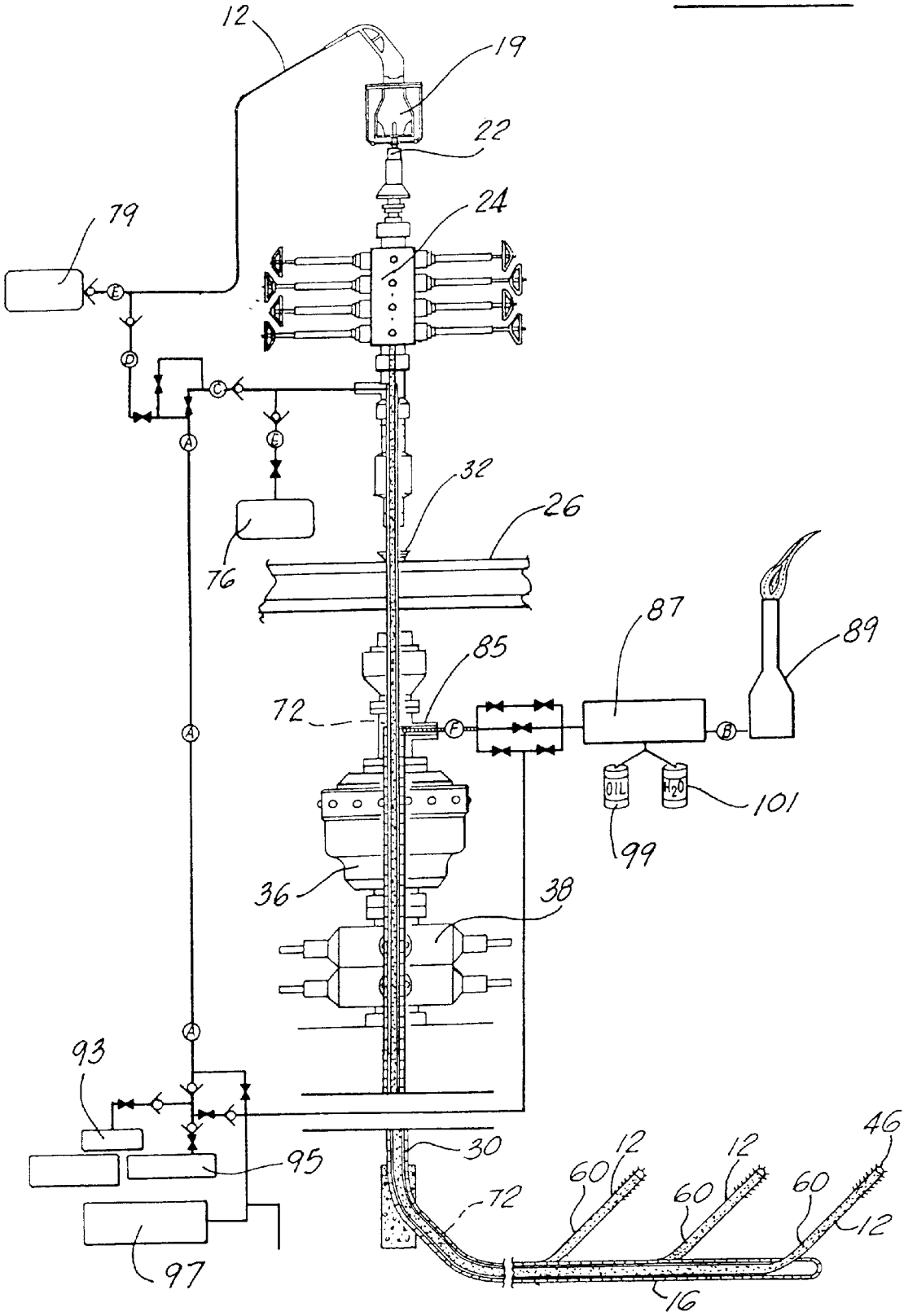
FIG. 8A illustrates an overall schematic view of underbalanced horizontal radial drilling (with surface schematic) while producing from a radial wellbore being drilled, and additional radial wellbores that have been drilled, with FIG. 8B illustrating a partial view of the system.
Figure 8B:
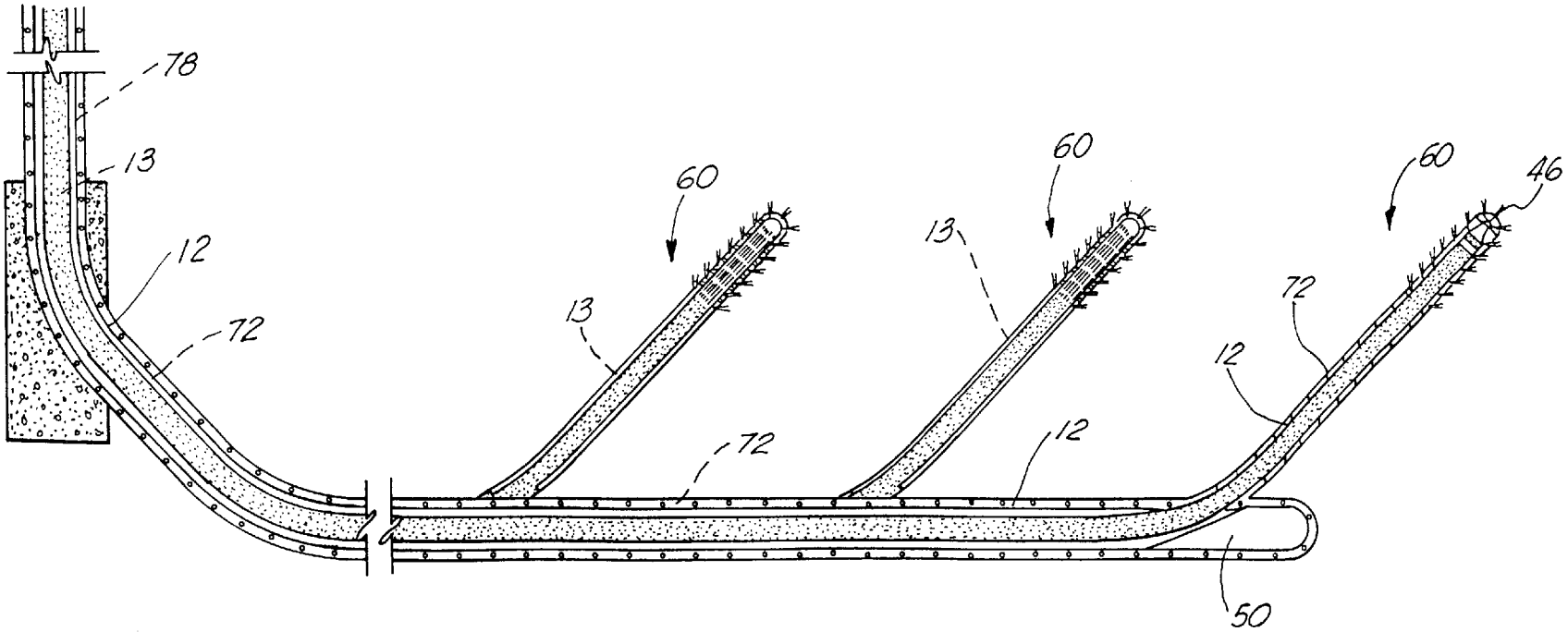

Likewise, FIGS. 8A and 8B illustrate the underbalanced horizontal radial drilling technique wherein a series of radial boreholes 60 have been drilled from a horizontal borehole 16. As seen in FIG. 7A, the furthest most borehole 60 is illustrated as being producing while being drilled with the coil tubing 12 and the drill bit 46. However, the remaining two radial boreholes 60 are completed boreholes, and are simply receiving hydrocarbons from the surrounding formation 70 into the inner bore of the radial boreholes 60. As was discussed in relation to FIGS. 7A and 7B, the hydrocarbons produced from the two completed boreholes 60 and the borehole 60 which was currently being drilled, would be retrieved into the annular space 72 between the wall of the borehole and the carrier string 30 within the borehole and would likewise be retrieved upward to be separated at the surface via separator 87. And, like the technique as illustrated in FIGS. 7A and 7B, the hydrocarbons moving up annulus 72 would include the air/nitrogen gas mixture and the drilling fluid which would be utilized during the drilling of radial well 60 via coil tubing 12, and again would be co-mingled with the hydrocarbons to be separated at the surface at separator 87. As was discussed earlier and as is illustrated, all other components of the system would be present as was discussed in relation to FIG. 6 earlier.

Turning now to FIG. 9, the system illustrated in FIG. 9 again is quite similar to the systems illustrated in FIGS. 7A, 7B and 8A, 8B and again illustrate a radial borehole 60 which is producing while being drilled with drill pipe 45 and drill bit 46, driven by power swivel 145. The second radial well 60 is likewise producing. However, this well has been completed and the hydrocarbons are moving to the surface via the inner bore within the radial bore 60 to be joined with the hydrocarbons from the first radial well 60. Unlike the drilling techniques as illustrated in FIGS. 7 and 8, FIG. 9 would illustrate that the hydrocarbons would be collected through the annular space 78 which is that space between the wall of the drill pipe 45 and the wall of the carrier string 30.

That is, rather than be moved up the outermost annular space 72 as illustrated in FIGS. 7 and 8, in this particular embodiment, the hydrocarbons mixed with the air/nitrogen gas and the drilling fluids would be collected in the annular space 78, which is interior to the outermost annular space 72 but would likewise flow and be collected in the separator for separation.

Figure 10:
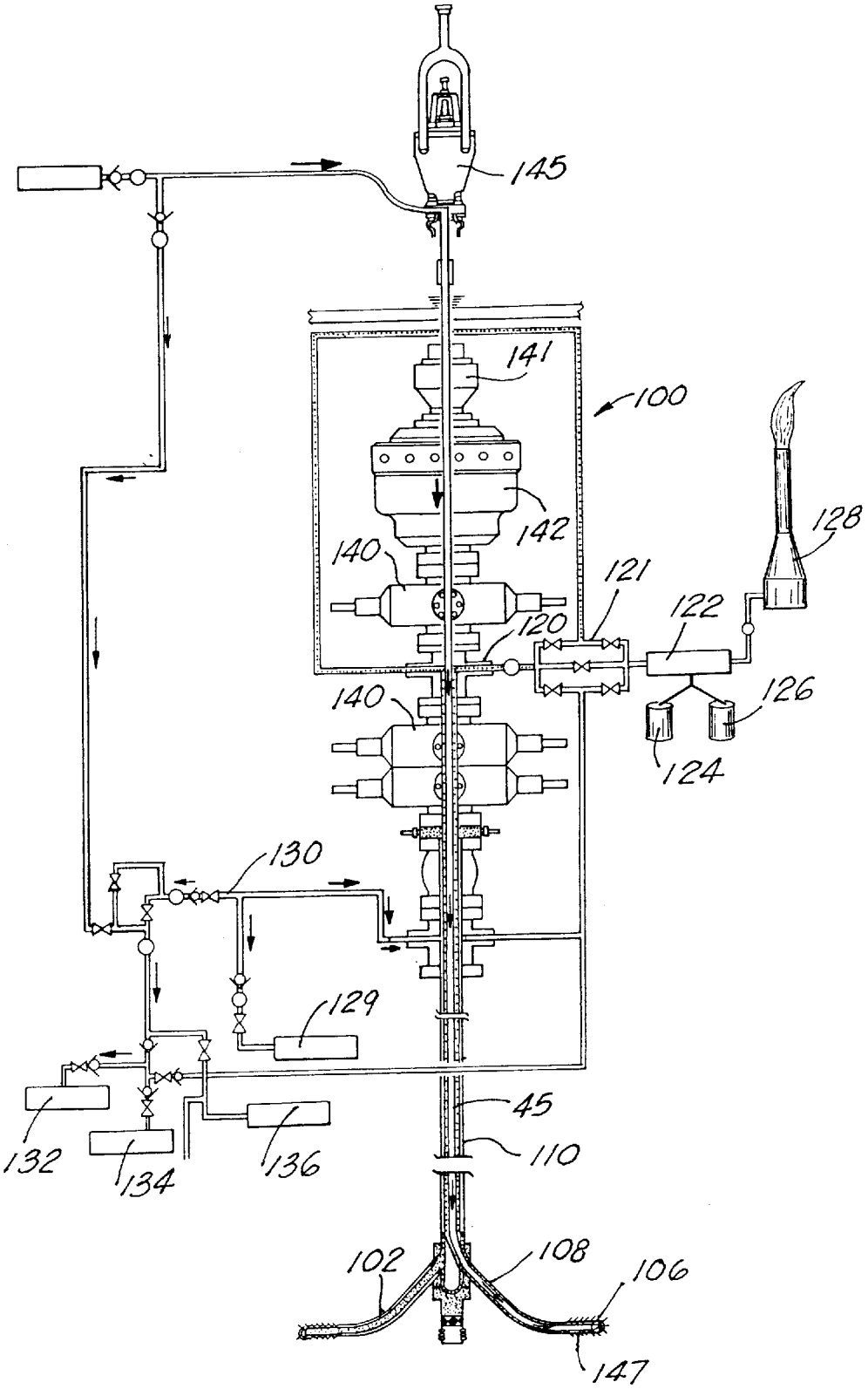
FIG. 10 illustrates a flow diagram for underbalanced drilling or completing of multilateral wells from a principal wellbore using the two string technique, including an upstock assembly, where there is illustrated a completed multilateral well that is producing and a multilateral well that is producing while drilling with a drill bit operated by a mud motor or rotary horizontal system is ongoing.
Figure 11:
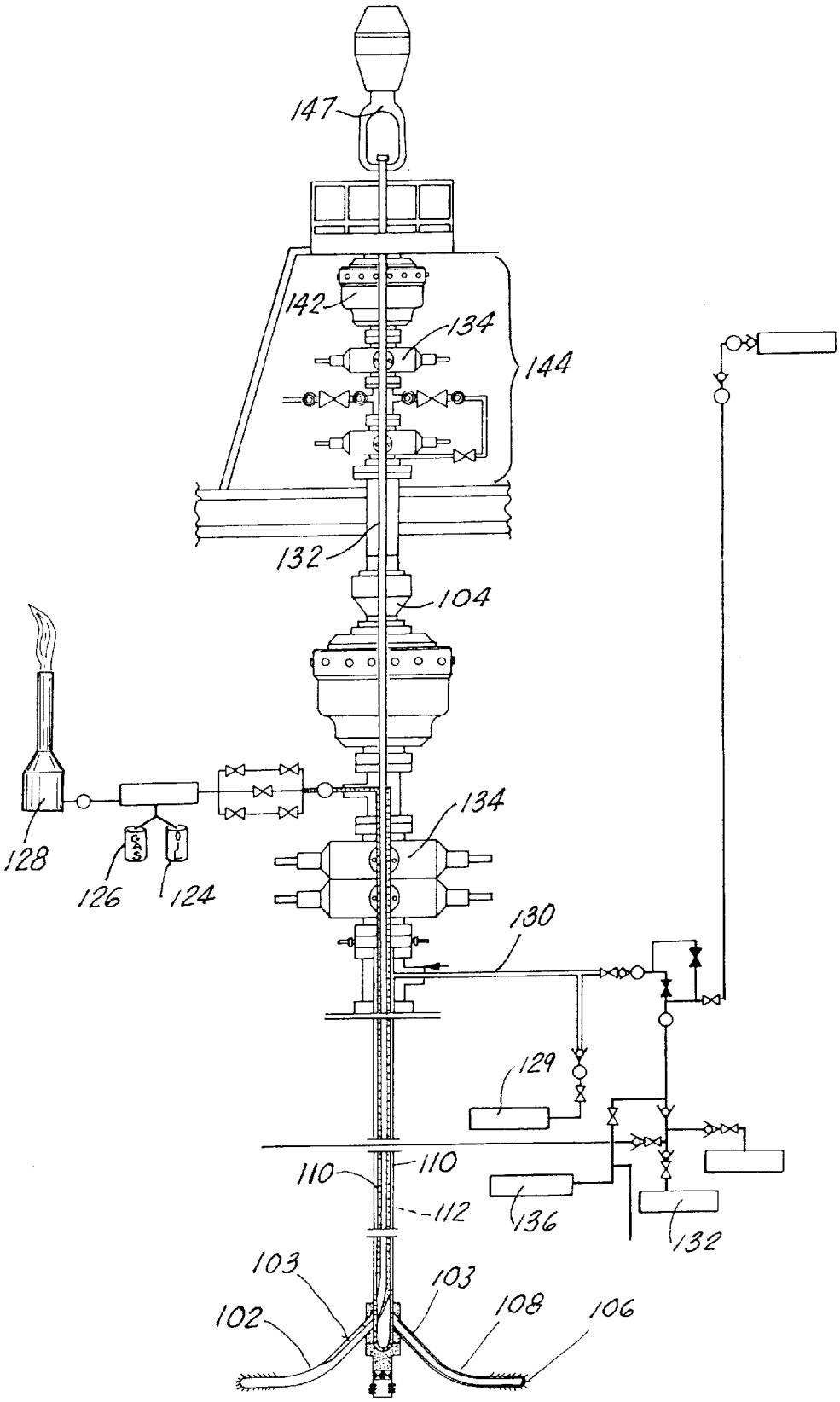
FIG. 11 illustrates a flow diagram for underbalanced drilling or completing of multilateral wells off of a principal wellbore utilizing the two string technique where there is a completed multilateral well that is producing and a multilateral well that is producing while drilling is ongoing utilizing drill pipe and a snubbing unit as part of the system.
Figure 12:
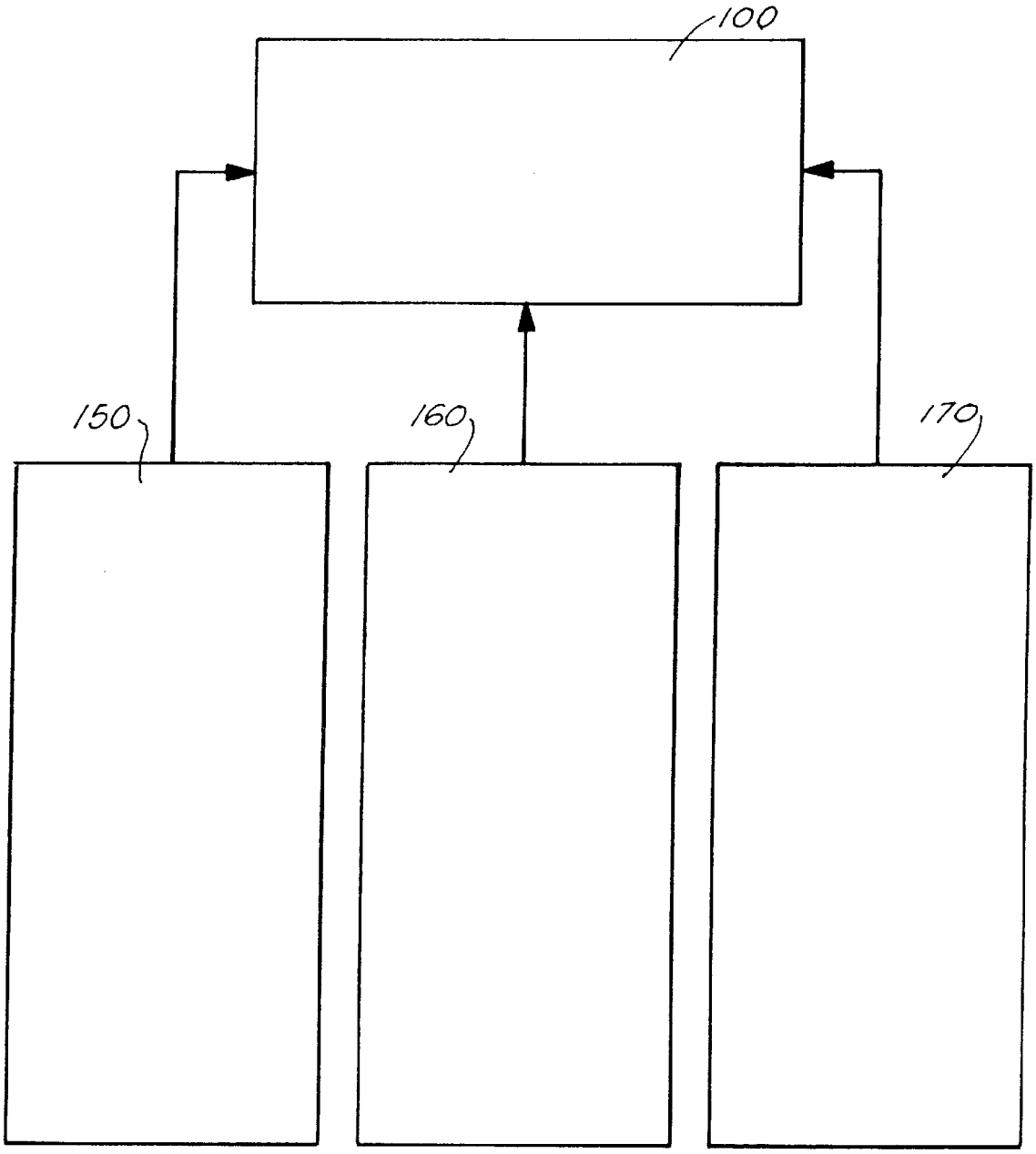
FIG. 12 is a representational flow chart of the components of the various subsystems that comprise the overall underbalanced dual string system of the present invention.

FIGS. 10 through 12 illustrate additional embodiments of the system of the present invention which is utilized for drilling or completing multilateral wells off of a principal wellbore. It should be noted that for purposes of definitions, the term "radial" wells and "multilateral" wells have been utilized in describing the system of the present invention. By definition, these terms are interchangeable in that they both in the context of this invention, constitute multiple wells being drilled off of a single principal wellbore, and therefore may be termed radial wells or multilateral wells. In any event, the definition would encompass more than one well extending out from a principal wellbore, whether the principal wellbore were vertically inclined, horizontally inclined, or at an angle, and whether the principal wellbore was a cased well or an uncased well. That is, in any of the circumstances, the system of the present invention could be utilized to drill or complete multilateral or radial wells off of a principal wellbore using the underbalanced technique, so that at least the principal wellbore could be maintained live while one or more of the radial or multilateral wells were being drilled or completed so as to maintain the well live and yet protect the surrounding formation because the system is an underbalanced system and therefore the hydrostatic pressure remains in balance.

Figure 9:
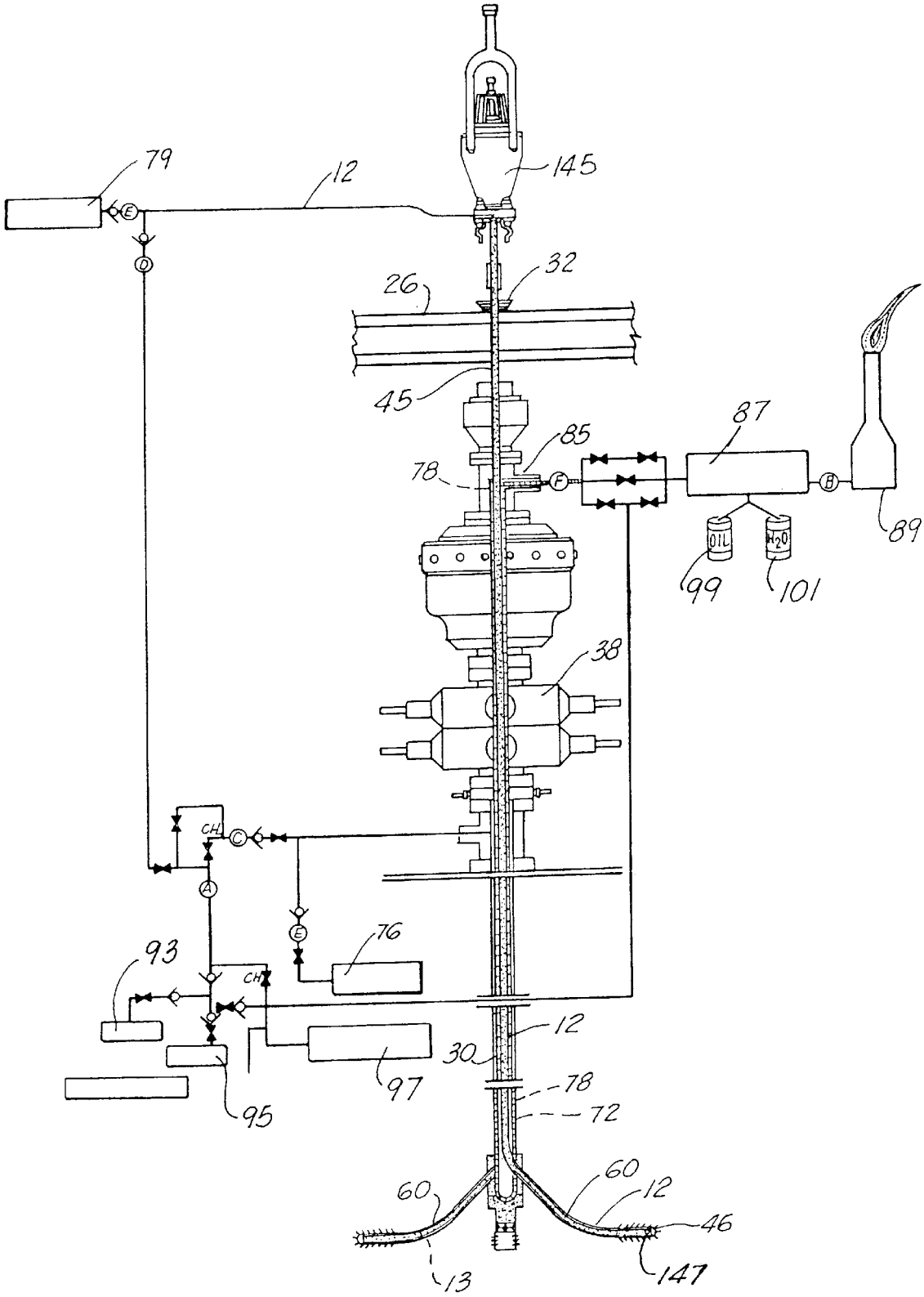
FIG. 9 illustrates a flow diagram for a jointed pipe system utilizing a top drive or power swivel system, for underbalanced drilling using the two string drilling technique with the upstock assembly where there is a completed radial well that is producing and a radial well that is producing while drilling.

FIG. 10, as illustrated, is a modification of FIG. 9, as was described earlier. Again, as seen in FIG. 10, the overall underbalanced system 100 would include first the drilling system which would in effect be a first multilateral borehole 102 which is illustrated as producing through its annulus up to surface via annulus 1 12, while a second borehole 108 is being drilled with a jointed pipe 45 powered by a top drive or power swivel 145, having a drill bit 106 at its end. The drill bit 106 may be driven by the top drive 145, or a mud motor 147 adjacent the bit 106, or both the top drive 145 and the mud motor 147. Fluid is being pumped down annulus 111 and hydrocarbon returns through the annulus between the drill string and the wall of the formation in the directional well. When the returns reach the upstock, the returns travel up annulus 112, comingling with the producing well 102. Simultaneously, fluids will be pumped down annulus 116, and this fluid joins the hydrocarbons up annulus 112.

As seen also in FIG. 9, FIGS. 10 and 10A illustrate that the hydrocarbons would be collected through the annular space 112 which would be defined by that space between the wall of the drill pipe 45 and the wall of the carrier string 114, which extends at least to the wellhead. Rather than the hydrocarbons moving up the outermost annular space 116 which would be that space between the outer casing 118 and the carrier string 114, in this embodiment, the hydrocarbons mix with the air nitrogen mix or with the other types of fluids would be collected in the annular space 112 which is interior to the most outer space 116 and would likewise flow and be collected in the separation system.

For clarity, reference is made to FIG. 10B which illustrates in cross sectional view the dual string system utilizing segmented drill pipe 45 rather than coiled tubing. The drill pipe 45 is positioned within the carrier string 114, and the carrier string 114 is being housed within casing 118. In this system, there would be defined an inner bore 111 in drill pipe 45, a second annulus 112 between the carrier string 114 and the drill pipe 45, and a third annulus 116 between the casing 118 and the carrier string 114. During the process of recovery utilizing segmented drill pipe 45, the drilling or completion fluids are pumped down annuli 111 and 116, and the returns, which may be a mixture of hydrocarbons and drilling fluids are returned up through annulus 112, which is modified from the use of coiled tubing as discussed previously in FIG. 2A.

Again, as was stated earlier, the overall system as seen in FIG. 10 would include the separation system which would include a collection pipe 120 which would direct the hydrocarbons into a separator 122 where the hydrocarbons would be separated into oil 124 and the water or drilling fluid 126. Any off gases would be burned in flare stack 128 as illustrated previously. Furthermore, the fluids that have been co-mingled with the hydrocarbons would be routed through line 120 where they would be routed through choke manifolds 121, and then to the separators 122.

This particular embodiment as illustrated in FIG. 10 also includes the containment system which is utilized in underbalanced drilling which includes the BOP stacks 140 and the hydril 142 and a rotating BOP 141 which would help to contain the system. This rotating BOP 141 allows one to operate with pressure by creating a closed system. In the case of coil tubing, the rotating BOP 141 and BOP stack controls the annulus between the carrier string and the outer casing, while in a rotary mode using drill pipe, when the carrier string is placed into the wellhead, there is seal between the carrier string and the outer casing, the rotating BOP 141 and the stack control the annulus between the drill pipe and the carrier string. Rotating BOPs are known in the art and have been described in articles, one of which entitled "Rotating Control Head Applications Increasing", which is being submitted herewith in the prior art statement.

Turning now to FIG. 11, again as with FIG. 10, there is illustrated the components of the system with the exception that in this particular configuration, the multilateral bore holes 102 and 108 with multilateral 102 producing hydrocarbons 103 as a completed well, and multilateral 108 producing hydrocarbons 103 while the drilling process is continuing. It should be noted that as seen in the FIG., that the hydrocarbons 103 are being comingled with the downhole fluids and returned up the carrier annulus 112 which is that space between the wall of the jointed drill pipe 45 and the wall of the carrier string 114. However when the drill pipe 45 is completely removed, returns travel up the annulus of the carrier string. As with the embodiment discussed in FIG. 10, the overall system comprises the sub systems of the containment system, the drilling system and the components utilized in that system, and the separation system which is utilized in the overall system.

However, unlike the embodiment discussed in FIG. 10, reference is made to FIGS. 11 and 11A where there appears the use of a snubbing unit 144 which is being used for well control during trips out of the hole and to keep the well under control during the process. With the snubbing unit 144 added, the well is maintained alive, and during the tripping out of the hole, one is able to circulate through the carrier string which keeps the well under control. As seen in the drawing, the snubbing unit 144 is secured to a riser 132 which has been nippled up to the rotating head at a point above the blow out assemblies 134. This is considered part of the well control system, or containment system, utilized during rotary drilling and completion operations. As is seen in the process, fluid is being circulated down annulus 116 between the carrier string and the wellbore and the returns are being taken up in annulus 112 between the drill string and the carrier string. The snubbing unit is a key component for being able to safely trip in and out of the wellbore during rotary drilling operations. When one is utilizing coiled tubing, there is a pressure containment system to control the annulus between the coiled tubing and the carrier string and the BOPs and rotating BOP 141 between the carrier string and the wellbore. With the use of the snubbing unit, this serves as the control for the annulus between the drill string and the carrier string. At the time one wishes to trip out of the wellbore, the snubbing unit 144 allows annular control in order to be able to do so since once it is opened, in order to retrieve the drill bit out of the hole, the well is alive. Therefore, the snubbing unit 144 allows one to retrieve the drill bit out of the hole and yet maintain the pressure of the underbalanced well to keep the well as a live well. It should be kept in mind that a snubbing unit is used only when the drilling or completion assembly is being tripped in and out of the hole.

Figure 11B:
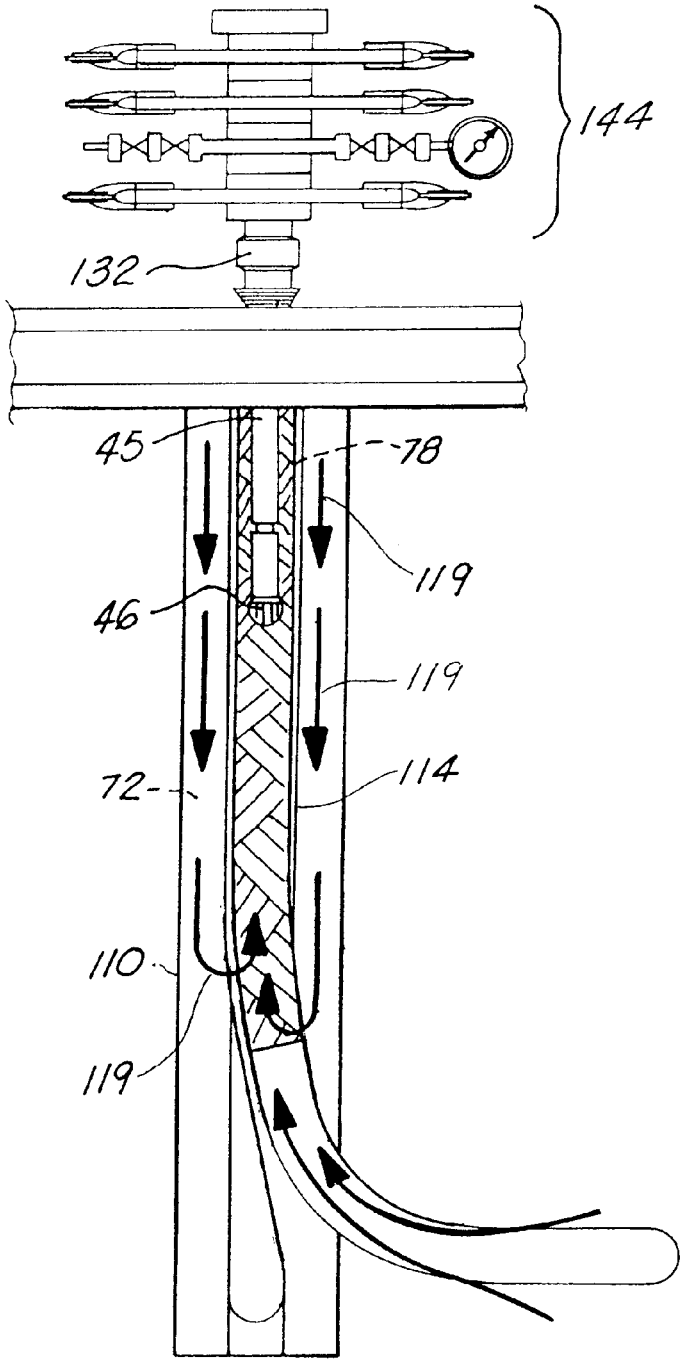
FIG. 11B illustrates the flow direction of drilling fluid and produced fluid for well control as it would be utilized with the snubbing unit during the tripping operation.

In the isolated view in FIG. 11B, there is illustrated the principal borehole 110, having the carrier string 114 placed within the borehole 110, with the drill string 45 being tripped out of the hole, i.e. the bore of the carrier string. As seen, the fluids indicated by arrows 119 are being pumped down the annular space 72 between the wall of the borehole 110 and the wall of the carrier string 114 and is being returned up the annulus 78 within the carrier string. The pumping of this trip fluid, i.e. fluid 119 down the annulus 72 of the borehole will enable the borehole to be maintained live, while tripping out of the hole with the drill string 45.

As was discussed previously in FIGS. 1–11, FIG. 12 illustrates a rough representation of the various components that may be included in the subsystems which comprise the overall, underbalanced dual string system 100. As illustrated, there is a first drilling/completion subsystem 150 which includes a list of components which may or may not be included in that subsystem, depending on the type of drilling or completion that is being undertaken. Further, there is a second subsystem 160 which is entitled the containment subsystem, which is a subsystem which comprises the various components for maintaining the well as a live well in the underbalanced the equilibrium that must be maintained if it is to be a successful system. Further, there is a third separation, subsystem 170 which comprises various components to undertake the critical steps of removing the hydrocarbons that have been collected from downhole from the various fluids that may have been pumped downhole in order to collect the hydrocarbons out of the formation. It is critical that all of the subsystems be part of the overall dual string system so that the method and system of the present invention is carried out in its proper manner.

The foregoing embodiments are presented by way of example only; the scope of the present invention is to be limited only by the following claims.

What is claimed is:

1. A method of drilling and completing multilateral wells in an underbalanced condition from a principal wellbore, comprising:

a) providing an overall system, which comprises:

i. a first drilling/completion subsystem, further comprising a drill string assembly having at least a drill bit and guidance system at an end of the drill string assembly;

ii. a containment subsystem for maintaining an underbalanced state within the wellbore, the containment system further comprising pressure control means such as a BOP stack, rotating BOP, or snubbing unit;

iii. a separation subsystem for separating hydrocarbons that have been co-mingled with drilling fluids as a hydrocarbon/drilling fluid mixture is returned to a surface of the wellbore, so that the hydrocarbons may be collected and separated from other fluids in the system;

b) lowering a carrier string into the wellbore, the carrier string having a deflection member on its lower end;

c) orienting the deflection member in a pre-selected direction;

d) lowering a segmented drill string assembly having a drill bit on its end into the carrier string and drilling a first multilateral well off of the deflection member in the preselected direction;

e) simultaneously circulating fluid down the bore of the segmented drill string assembly and an annulus between the carrier string and a wall of the borehole, of sufficient weight to provide an underbalanced state without the fluid entering the formation;

f) retrieving the drill string assembly and reorienting the deflection member to drill at least a second multilateral well, while maintaining the first multilateral well as a live well; and g) returning to the surface any hydrocarbons received from any of the multilateral wells through an annulus between the carrier string and the segmented drill string assembly co-mingled with the circulated fluid.

2. The system and method in claim 1, wherein the containment subsystem maintains the first multilateral well as a live well so that other multilateral wells may be drilled and completed while the well is producing.

3. The system and method in claim 1, wherein the separation subsystem separates and stores the hydrocarbons apart from the other fluids carried to the surface.

4. The system and method in claim 1, further comprising at least a dual string drilling system having a segmented drill string assembly within a carrier string so that fluids are introduced into the wellbore in a first annulus of the drill string and in an annulus between the carrier string and a wall of the well bore, and the hydrocarbons and fluid mixture is returned to the surface for separation through an annulus between the drill string assembly and the carrier string.

5. The system and method in claim 1, wherein the principal wellbore may be a vertical wellbore, a horizontal wellbore or a laterally oriented wellbore.

6. The system and method in claim 1, wherein the principal wellbore may be a cased or an open wellbore.

7. The system and method in claim 1, wherein the fluids pumped down the drill string annulus and the annulus between the carrier string and the wellbore may comprise nitrogen gas, air, or a combination of nitrogen and water, for use in the drilling or completion operation.

8. The system and method in claim 1, wherein the drill string assembly comprises jointed drill pipe rotated by a power swivel, top drive, or rotary table, and a drill bit rotated by a mud motor or a combination of the top drive, power swivel or rotary table and the mud motor.

9. The system and method in claim 1, wherein the fluid flowing down a drill string annulus and an annulus between the carrier string and the wall of the wellbore, returns to the rig floor through the annulus between the drill pipe and the carrier string, and comprises a mixture of drilling fluids and hydrocarbons.

10. The system and method in claim 1, wherein the underbalanced state is established in the drilling subsystem by circulating fluid down the annulus between the carrier string and the wall of the wellbore, of sufficient weight to keep the well under control, and comingling with produced fluid and hydrocarbons, and returned up an annulus between the drill string and a carrier string, so that the drill string assembly may be pulled from a carrier string while maintaining the well as a live producing well in the carrier string annulus, allowing other multilateral wells to be drilled.

11. The system and method in claim 10, wherein the co-mingled fluid returning to a rig floor through the carrier string annulus is routed to a separation means to separate the drilling fluid mixture from the liquid hydrocarbons.

12. The system and method in claim 1, wherein the drilling subsystem may further comprise coil tubing, and a drill bit at the end of the coiled tubing bottom hole assembly, a deflection member at the end of a carrier string, and a means for rotating the drill bit during drilling operations.

13. The system and method in claim 1, wherein the separation subsystem further comprises a choke manifold, a separator for separating the fluids into drilling fluids and hydrocarbons, and a series of tanks for storing the separated hydrocarbons during completion of the well.

14. The system and method in claim 1, wherein the step of orienting the deflection member may be accomplished by utilizing internal orienting devices, such as gyro, steering tool, or MWD, or by some form of an external self-orienting device located in the primary casing string, that would orient the deflecting device, such as a mule shoe, or a latch coupling device.

15. A method of drilling and completing multilateral wells in an underbalanced state, from a principal wellbore, utilizing a dual string configuration, the method comprising the following steps:

a) providing the principal wellbore;

b) lowering a carrier string into the wellbore, the carrier string having a deflection member on its lower end;

c) orienting the deflection member in a pre-selected direction;

d) lowering a segmented drill string assembly having a drill bit on its end into the carrier string for drilling a first multilateral well off of the deflection member in the pre-selected direction;

e) simultaneously circulating fluid down the bore of the segmented drill string assembly and an annulus between the carrier string and a wall of the borehole, of sufficient weight to provide an underbalanced state without fluid entering a formation;

f) retrieving the drill string assembly and reorienting the deflection member to drill at least a second multilateral well, while maintaining the first multilateral well as a live well; and g) returning to a surface of the wellbore any hydrocarbons received from the first multilateral well through an annulus between the carrier string and the segmented drill string co-mingled with the circulated fluid, while drilling a second multilateral well by repeating steps b) through e).

16. The method in claims 15, after the first multilateral well is drilled, further comprising the step of retrieving the drill string assembly and reorienting the deflection member and carrier string to drill a second multilateral well, while maintaining the first multilateral well as a live well so that other multilateral wells may be drilled and completed while the well is producing.

17. A method of drilling and completing multilateral wells in an underbalanced state, from a principal wellbore, utilizing a dual string configuration, the method comprising the following steps:

a) providing the principal wellbore;

b) lowering a carrier string into the wellbore, the carrier string having a deflection member on its lower end;

c) orienting the deflection member in a pre-selected direction;

d) lowering a coiled tubing assembly having a drill bit on its end into the carrier string for drilling a first multilateral well off of the deflection member in the pre-selected direction;

e) simultaneously circulating fluid down a bore of the coiled tubing assembly and an annulus between the coiled tubing and the carrier string of sufficient weight to provide an underbalanced state without fluid entering the formation; and f) retrieving the coiled tubing assembly and reorienting the deflection member to drill at least a second multilateral well, while maintaining the first multilateral well as a live well; and g) returning to a surface of the wellbore any hydrocarbons received from the first multilateral well through an annulus between the carrier string and the wellbore co-mingled with the circulated fluid, while drilling a second multilateral well by repeating steps b) through e).

18. A system of drilling or completing multilateral wells from a principal wellbore utilizing underbalanced drilling, comprising:

a) a first drilling/completion subsystem, further comprising at least a drill bit on an end of segmented drill pipe, the drill bit driven by a power means;

b) a containment subsystem for maintaining an underbalanced state within the wellbore, the containment system further comprising at least pressure controls such as a rotating BOP stack or snubbing unit;

c) a separation subsystem for separating hydrocarbons that have been comingled with drilling fluids as the hydrocarbon/drilling fluid mixture is returned to a surface of the wellbore, so that the hydrocarbons may be collected and separated from other fluids in the system;

d) the overall system further comprising at least a dual string drilling system having a drill string within a carrier string providing further that fluids are introduced into the wellbore through the drill string, and an annulus between the carrier string and the wellbore, and a hydrocarbon and fluid mixture is returned to the surface for separation through an annulus between the carrier string and the drill string.

19. The method in claim 18, wherein an upper end of the carrier string extends from the deflection member at least to the wellhead.

* * * * *

UNITED STATES PATENT AND TRADEMARK OFFICE

CERTIFICATE OF CORRECTION

PATENT NO. : 6,065,550
DATED : May 23, 2000
INVENTOR(S) : Robert Gardes

It is certified that error appears in the above-identified patent and that said Letters Patent is hereby corrected as shown below:

Column 6,
Line 43, replace “hydril” with -- annular blowout preventor --

Column 7,
Line 61, replace “36” with -- 26 --

Column 12,
Line 22, replace “hydril” with -- annular blowout preventor --

Signed and Sealed this

Eleventh Day of February, 2003

JAMES E. ROGAN
*Director of the United States Patent and Trademark Office*